US009798256B2

(12) United States Patent
Kosaki et al.

(10) Patent No.: US 9,798,256 B2
(45) Date of Patent: Oct. 24, 2017

(54) METHOD OF PRODUCING TONER

(71) Applicant: CANON KABUSHIKI KAISHA, Tokyo (JP)

(72) Inventors: Yusuke Kosaki, Susono (JP); Noritaka Toyoizumi, Mishima (JP); Tetsuya Kinumatsu, Mishima (JP); Kenji Aoki, Mishima (JP); Shuntaro Watanabe, Hadano (JP); Takaaki Kaya, Suntou-gun (JP); Atsushi Tani, Suntou-gun (JP); Takashige Kasuya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/178,333

(22) Filed: Jun. 9, 2016

(65) Prior Publication Data

US 2017/0003610 A1 Jan. 5, 2017

(30) Foreign Application Priority Data

Jun. 30, 2015 (JP) ..... 2015-131016

(51) Int. Cl.
*G03G 9/087* (2006.01)
*G03G 9/08* (2006.01)

(52) U.S. Cl.
CPC ..... *G03G 9/0806* (2013.01); *G03G 9/0804* (2013.01); *G03G 9/08755* (2013.01);
(Continued)

(58) Field of Classification Search
CPC .. G03G 9/0804; G03G 9/0806; G03G 9/0808; G03G 9/08773
See application file for complete search history.

(56) References Cited

U.S. PATENT DOCUMENTS 5,298,354 A 3/1994 Matsunaga et al.
5,300,386 A 4/1994 Kanbayashi et al.
(Continued)

FOREIGN PATENT DOCUMENTS

JP 2007-256941 A 10/2007
JP 2009-052005 A 3/2009
(Continued)

OTHER PUBLICATIONS

U.S. Appl. No. 15/071,981, Kenji Aoki, filed Mar. 16, 2016.
(Continued)

*Primary Examiner* — Peter Vajda
(74) *Attorney, Agent, or Firm* — Fitzpatrick Cella Harper and Scinto

(57) ABSTRACT

A method of producing a toner includes preparing a resin solution containing a binder resin, a colorant and an organic solvent; forming a droplet, a surface of the droplet being covered with a resin fine particle L1; introducing a resin fine particle L2; pressuring by introducing carbon dioxide, and extracting the organic solvent in the droplet; and obtaining the toner particle by removing the carbon dioxide together with the extracted organic solvent, wherein the SP value of the resin R1 constituting the resin fine particle L1 and the SP value of the resin R2 constituting the resin fine particle L2 are each within a specific range.

8 Claims, 1 Drawing Sheet

(52) U.S. Cl.
CPC ..... *G03G 9/08773* (2013.01); *G03G 9/08795* (2013.01); *G03G 9/08797* (2013.01)

(56) References Cited

U.S. PATENT DOCUMENTS

| | | | |
|---|---|---|---|
| 5,407,776 | A | 4/1995 | Kanbayashi et al. |
| 5,478,686 | A | 12/1995 | Kawakami et al. |
| 5,500,321 | A | 3/1996 | Kasuya et al. |
| 5,529,873 | A | 6/1996 | Chiba et al. |
| 5,558,967 | A | 9/1996 | Nagatsuka et al. |
| 5,571,653 | A | 11/1996 | Kasuya et al. |
| 5,578,407 | A | 11/1996 | Kasuya et al. |
| 5,691,093 | A | 11/1997 | Kanbayashi et al. |
| 5,700,616 | A | 12/1997 | Kasuya et al. |
| 5,712,073 | A | 1/1998 | Katada et al. |
| 5,840,457 | A | 11/1998 | Urawa et al. |
| 5,972,553 | A | 10/1999 | Katada et al. |
| 6,002,895 | A | 12/1999 | Kasuya et al. |
| 6,214,509 | B1 | 4/2001 | Kasuya et al. |
| 6,300,024 | B1 | 10/2001 | Yusa et al. |
| 6,485,875 | B1 | 11/2002 | Karaki et al. |
| 6,586,151 | B1 | 7/2003 | Naka et al. |
| 6,664,016 | B2 | 12/2003 | Kanbayashi et al. |
| 6,751,424 | B2 | 6/2004 | Komatsu et al. |
| 6,875,549 | B2 | 4/2005 | Yamazaki et al. |
| 6,881,527 | B2 | 4/2005 | Moribe et al. |
| 7,014,969 | B2 | 3/2006 | Yachi et al. |
| 7,147,980 | B2 | 12/2006 | Itakura et al. |
| 7,150,953 | B2 | 12/2006 | Yamazaki et al. |
| 7,229,727 | B2 | 6/2007 | Itakura et al. |
| 7,238,387 | B2 | 7/2007 | Ogawa et al. |
| 7,244,539 | B2 | 7/2007 | Baba et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,422,832 | B2 | 9/2008 | Ogawa et al. |
| 7,452,649 | B2 | 11/2008 | Magome et al. |
| 7,537,877 | B2 | 5/2009 | Yoshiba et al. |
| 7,582,401 | B2 | 9/2009 | Ogawa et al. |
| 7,678,524 | B2 | 3/2010 | Hasegawa et al. |
| 7,700,254 | B2 | 4/2010 | Moribe et al. |
| 7,704,659 | B2 | 4/2010 | Ogawa et al. |
| 7,776,501 | B2 | 8/2010 | Tamura et al. |
| 7,794,908 | B2 | 9/2010 | Kaya et al. |
| 7,794,909 | B2 | 9/2010 | Kaya et al. |
| 7,811,734 | B2 | 10/2010 | Ogawa et al. |
| 7,935,771 | B2 | 5/2011 | Fukui et al. |
| 7,939,231 | B2 | 5/2011 | Ogawa et al. |
| 7,943,281 | B2 | 5/2011 | Kaya et al. |
| 8,084,174 | B2 | 12/2011 | Hasegawa et al. |
| 8,093,342 | B2 | 1/2012 | Minami et al. |
| 8,110,329 | B2 | 2/2012 | Tominaga et al. |
| 8,178,275 | B2 | 5/2012 | Tani et al. |
| 8,372,573 | B2 | 2/2013 | Ayaki et al. |
| 8,383,312 | B2 | 2/2013 | Fujimoto et al. |
| 8,460,845 | B2 | 6/2013 | Kaya et al. |
| 8,465,896 | B2 | 6/2013 | Sekikawa et al. |
| 8,475,987 | B2 | 7/2013 | Kaya et al. |
| 8,497,056 | B2 | 7/2013 | Sekikawa et al. |
| 8,551,680 | B2 | 10/2013 | Ayaki et al. |
| 8,603,712 | B2 | 12/2013 | Aoki et al. |
| 8,652,725 | B2 | 2/2014 | Watanabe et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu et al. |
| 8,975,000 | B2 | 3/2015 | Tani et al. |
| 9,056,956 | B2 | 6/2015 | Kojima et al. |
| 9,057,971 | B2 | 6/2015 | Watanabe et al. |
| 9,176,410 | B2 | 11/2015 | Tani et al. |
| 9,309,349 | B2 | 4/2016 | Watanabe et al. |
| 2002/0055053 | A1 | 5/2002 | Kasuya et al. |
| 2004/0110076 | A1 | 6/2004 | Yamazaki et al. |
| 2010/0035171 | A1 | 2/2010 | Watanabe et al. |
| 2010/0273102 | A1 | 10/2010 | Tamura et al. |
| 2013/0130169 | A1 | 5/2013 | Aoki et al. |
| 2014/0134532 | A1* | 5/2014 | Sumioka ..... G03G 9/09371 430/109.4 |
| 2014/0349232 | A1 | 11/2014 | Kinumatsu et al. |
| 2015/0355563 | A1 | 12/2015 | Aoki et al. |
| 2016/0187797 | A1 | 6/2016 | Kosaki et al. |
| 2016/0187798 | A1 | 6/2016 | Toyoizumi et al. |

FOREIGN PATENT DOCUMENTS

| | | | | |
|---|---|---|---|---|
| JP | 2012-042939 | A | 3/2012 | |
| JP | 2013-011884 | A | 1/2013 | |
| JP | 2013-083919 | A | 5/2013 | |
| JP | 2013-137535 | A | 7/2013 | |
| WO | WO 2013/081172 | * | 6/2013 | ..... G03G 9/087 |

OTHER PUBLICATIONS

U.S. Appl. No. 15/073,572, Tetsuya Kinumatsu, filed Mar. 17, 2016.
U.S. Appl. No. 15/176,520, Noritaka Toyoizumi, filed Jun. 8, 2016.

* cited by examiner

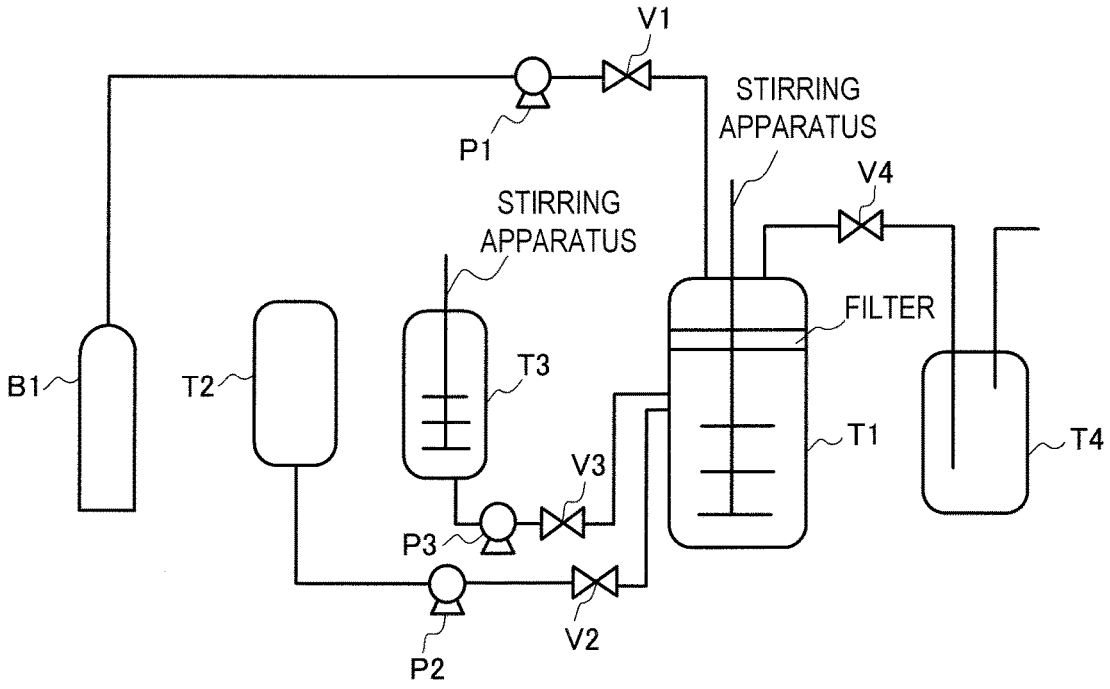
V1
STIRRING
APPARATUS
P1
V4
STIRRING
APPARATUS
FILTER
B1
T2
T3
T1
T4
V3
P3
V2
P2

METHOD OF PRODUCING TONER

BACKGROUND OF THE INVENTION

Field of the Invention

The present invention relates to a method of producing a toner, the method used for a recording method utilizing an electrophotographic method, an electrostatic recording method and a toner jet recording method.

Description of the Related Art

In recent years, the high definition of a toner image has been required in an electrophotographic field. In order to form a high definition image, it is important that toner particles have uniform performance among themselves. Therefore, it is effective to equalize the particle diameters of the toner particles, to provide sharp particle size distribution and to suppress the occurrence of a variant particle having a low circularity.

A "dissolution suspension method" has been known as a producing method which can easily achieve the sharp particle size distribution and high circularity of the toner particle. The dissolution suspension method includes dispersing a resin solution in which a resin is previously dissolved in an organic solvent in a dispersion medium, to form a droplet of the resin solution, and thereafter removing the organic solvent to obtain a toner particle.

In the dissolution suspension method, a water-based medium is commonly used as a dispersion medium. However, when the water-based medium is used, enormous energy and time are required for a washing step and a drying step after the particle is formed. So, in recent years, a method of producing a toner wherein carbon dioxide is used as a dispersion medium has been proposed.

In this method, after a dispersion in which a droplet of a resin solution is dispersed in carbon dioxide as a dispersion medium is formed, carbon dioxide is further introduced into the dispersion, and an organic solvent in the droplet is extracted and removed to obtain a toner particle. The method can reduce pressure after removing the solvent to easily separate the obtained toner particle from carbon dioxide as a dispersion medium, and produce the toner particle with energy saved and at low cost without requiring a washing step and a drying step.

When a toner is produced according to a dissolution suspension method using carbon dioxide for a dispersion medium, it is necessary to use a dispersant functioning from a droplet forming step to a solvent removing step in order to achieve sharp particle size distribution and a high circularity. The dispersant covers the surface of the droplets of the resin solution, to suppress the aggregation and sedimentation of the droplets, which provides stable dispersion of the droplets and maintains the dispersion state of the droplets. Therefore, the selection of the dispersant is important.

Japanese Patent Application Laid-Open No. 2009-052005 proposes a method of producing a resin particle, wherein carbon dioxide in a liquid state or a supercritical state is utilized as a dispersion medium, and a resin fine particle containing behenyl acrylate and methacrylic modified silicone is used for a dispersant.

Japanese Patent Application Laid-Open No. 2013-137535 proposes a toner produced in a dispersion medium containing carbon dioxide using a resin fine particle. The resin fine particle contains a resin having a comb type structure including a segment having an organopolysiloxane structure and a segment having an aliphatic polyester structure.

In this method, a droplet is formed in the amount of carbon dioxide introduced less than that of the method of Japanese Patent Application Laid-Open No. 2009-052005, and carbon dioxide is further introduced to remove a solvent. Therefore, the viscosity of the droplet when the droplet is formed is maintained in a comparatively low state, which can provide a toner particle having good particle size distribution to a certain degree.

SUMMARY OF THE INVENTION

When the present inventors considered the production of a toner based on the method of Japanese Patent Application Laid-Open No. 2009-052005, the inventors found that a toner particle having good particle size distribution is not necessarily obtained. When the inventors considered the cause, the inventors found that the compositions of the droplet and dispersion medium are changed according to the amount of carbon dioxide introduced. In the dissolution suspension method wherein carbon dioxide is utilized as a dispersion medium, part of the organic solvent in the droplet is extracted into the dispersion medium in the droplet forming step, which causes the increase in the concentration of the resin in the droplet. When the amount of carbon dioxide introduced is decreased, the amount of the organic solvent extracted from the droplet is decreased, which maintains the viscosity of the droplet in a sufficiently low state. In this case, the contact or coalescence of the droplets can be easily eliminated under shear, which easily provides a toner particle having good particle size distribution. On the other hand, when the amount of carbon dioxide introduced is increased, the amount of the organic solvent extracted from the droplet is increased, which causes the increase in the viscosity of the droplet. In this case, the contact or coalescence of the droplets cannot be eliminated under shear, which is less likely to provide a toner particle having good particle size distribution. The inventors presume that the conditions described in the literature cause the increased amount of carbon dioxide introduced in the droplet forming step and the increased viscosity of the droplet, which makes the formation of the uniform droplet difficult.

In order to further improve the particle size distribution based on the method of Japanese Patent Application Laid-Open No. 2013-137535, the droplet is formed under a condition in which the viscosity of the droplet can be kept further lower, i.e., under a condition in which the amount of carbon dioxide introduced is further reduced. However, rather, the present inventors found that the toner particle having good particle size distribution is not obtained. When the inventors considered the cause, the inventors found that the amount of carbon dioxide introduced in order to remove the solvent must be increased by reducing the amount of carbon dioxide introduced in the droplet forming step, which causes the increases in composition changes in the droplet and the dispersion medium from the droplet forming step to the solvent removing step. As a result, the inventors presume that the dispersant cannot be adapted for the composition change, and the coalescence of the droplets cannot be sufficiently suppressed.

In view of the above problems, the present invention provides a method of producing a toner having sharp particle size distribution and a high circularity at low cost.

The present invention is directed to providing a method of producing a toner including a toner particle, the method including:

a) preparing a resin solution containing a binder resin, a colorant and an organic solvent;

b) providing a dispersion in which a droplet of the resin solution is dispersed in a dispersion medium containing carbon dioxide, in a pressure container, a surface of the droplet of the resin solution being covered with a resin fine particle L1, and the resin fine particle L1 containing a resin R1;

c) further introducing a resin fine particle L2 into the dispersion, the resin fine particle L2 containing a resin R2;

d) pressurizing the dispersion by introducing carbon dioxide into the pressure container, and extracting the organic solvent in the droplet into the dispersion medium; and e) obtaining the toner particle by removing the carbon dioxide together with the extracted organic solvent from inside of the pressure container, wherein:

the resin R1 and the resin R2 satisfy the following formula (1):

$$2.0 \leq (SP(R1)-SP(R2))/SP(R1) \times 100 \leq 15.0 \quad (1),$$

in the formula (1),

SP (R1) represents a solubility parameter of the resin R1 $((J/cm^3)^{1/2})$; and SP (R2) represents a solubility parameter of the resin R2 $((J/cm^3)^{1/2})$.

Further features of the present invention will become apparent from the following description of exemplary embodiments with reference to the attached drawing.

BRIEF DESCRIPTION OF THE DRAWINGS

FIGURE illustrates an example of a production apparatus used for producing a toner of the present invention.

DESCRIPTION OF THE EMBODIMENTS

Preferred embodiments of the present invention will now be described in detail in accordance with the accompanying drawing.

A method of producing a toner according to a dissolution suspension method using carbon dioxide as a dispersion medium, which characterizes the present invention, includes the following a) to e):

a) preparing a resin solution containing a binder resin, a colorant and an organic solvent;

b) providing a dispersion in which a droplet of the resin solution is dispersed in a dispersion medium containing carbon dioxide, in a pressure container, a surface of the droplet of the resin solution being covered with a resin fine particle L1;

c) further introducing a resin fine particle L2 into the dispersion;

d) pressurizing the dispersion by introducing carbon dioxide into the pressure container, and extracting the organic solvent in the droplet into the dispersion medium; and e) obtaining the toner particle by removing the carbon dioxide together with the extracted organic solvent from inside of the pressure container.

The carbon dioxide as a dispersion medium used for the method of producing a toner of the present invention may be used alone, or may contain an organic solvent as another component thereof. However, the carbon dioxide needs to be in a liquid state.

Steps a) to e) in the producing method of the present invention will be described in detail below.

In step a), first, a binder resin is mixed with an organic solvent which can dissolve the binder resin. The binder resin is homogeneously dissolved with a dispersing unit such as a homogenizer, a ball mill, a colloid mill or an ultrasonic disperser to prepare a resin solution. At this time, a colorant, and, as necessary, wax and other additives can be mixed.

Examples of the organic solvent include: ketone-based solvents such as acetone, methyl ethyl ketone, methyl isobutyl ketone and di-n-butyl ketone; ester-based solvents such as ethyl acetate, butyl acetate and methoxybutyl acetate; ether-based solvents such as tetrahydrofuran, dioxane, ethyl cellosolve and butyl cellosolve; amide-based solvents such as dimethylformamide and dimethylacetamide; and aromatic hydrocarbon-based solvents such as toluene, xylene, ethylbenzene and 2-phenyl ethanol.

In step b), a resin solution, a resin fine particle L1 as a dispersant, and carbon dioxide as a dispersion medium are mixed and pressurized in a pressure container, and stirred in the pressure container using a stirring unit. Thus, a dispersion in which a droplet of the resin solution is dispersed in the dispersion medium containing carbon dioxide is provided. The surface of the droplet of the resin solution is covered with the resin fine particle L1.

Examples of the method of providing the dispersion of the droplet include:

(1) a method including introducing a mixture obtained by previously mixing a resin solution with a resin fine particle L1 into a pressure container, and thereafter adding carbon dioxide in a state where the mixture is stirred using a stirring unit;

(2) a method including injecting a resin solution into a pressure container, and thereafter adding carbon dioxide containing a previously dispersed resin fine particle L1 in a state where the resin solution is stirred using a stirring unit;

(3) a method including injecting carbon dioxide into a pressure container, and thereafter adding a mixture obtained by previously mixing a resin solution with a resin fine particle L1 in a state where the carbon dioxide is stirred using a stirring unit; and (4) a method including injecting carbon dioxide containing a previously dispersed resin fine particle L1 into a pressure container, and thereafter adding a resin solution in a state where the carbon dioxide is stirred using a stirring unit.

As in the methods (3) and (4), in the method including injecting carbon dioxide first into the pressure container, the resin solution or the mixture of the resin solution and resin fine particle L1 can be introduced using a high-pressure pump.

In step b), a disperse phase containing the droplet of the resin solution and a continuous phase containing carbon dioxide as a dispersion medium are formed. Since part of the organic solvent in the droplet is extracted into carbon dioxide at this time, the dispersion medium contains carbon dioxide and the organic solvent. The composition of the dispersion medium is influenced by the amount of carbon dioxide introduced, i.e., the pressure inside the pressure container.

In order to stably form the droplet, the pressure inside the pressure container is preferably 1.5 MPa or more and 6.0 MPa or less. The pressure can be controlled by adjusting the amount of carbon dioxide introduced. When the pressure inside the pressure container is 1.5 MPa or more, the phase separation of the disperse phase and continuous phase is apt to occur, which is more preferable in respect of the ease of forming the droplet. On the other hand, when the pressure inside the pressure container is 6.0 MPa or less, the viscosity increase of the droplet is suppressed without excessively increasing the amount of the organic solvent extracted into the dispersion medium side out of the droplet, which is more preferable in respect of the formation of the uniform droplet. More preferably, the pressure inside the pressure container is 1.5 MPa or more and 4.5 MPa or less.

In step c), a resin fine particle L2 is introduced, which can be adapted for the composition fluctuations in the disperse phase and the continuous phase occurring in steps after step c) in which the amount of carbon dioxide introduced is increased as compared with step d). In this way, the aggregation of the droplets in the steps after step c) can be suppressed.

A method of introducing a resin fine particle L2 can be a method including providing a dispersion of a droplet in a pressure container, and thereafter adding the resin fine particle L2 in a state where the dispersion is stirred using a stirring unit. Specifically, first, a resin fine particle L2 is charged into a pressure tank connected to a pressure container via a closed valve. The resin fine particle L2 is introduced by utilizing a pressure difference provided by setting the pressure inside the pressure tank to be higher than that in the pressure container, and thereafter opening the valve. At this time, the resin fine particle L2 may be introduced by using a high-pressure pump. In this case, the resin fine particle L2 can be introduced without greatly fluctuating the pressure inside the pressure container by using a pressure tank having a smaller volume than that of the pressure container. The resin fine particle L2 can be introduced in a state where the resin fine particle L2 is dispersed in an organic solvent. In order to introduce a proper amount of the resin fine particle L2, it is necessary to use a pressure tank having a certain size. Therefore, the volume ratio of the pressure tank to the pressure container is preferably 1/20 or more and 1/2 or less, and more preferably 1/10 or more and 1/2 or less. The resin fine particle L2 can also be introduced in a stepwise manner by providing a plurality of independently pressure-controllable pressure tanks. In this case, different kinds of resin fine particles L2 (resin fine particle (L2-1), resin fine particles (L2-2), resin fine particles (L2-3), . . . ) can also be charged into a plurality of pressure tanks. The effect of suppressing aggregation of the droplets is further improved by alternately performing step c) and step d) to be described below to sequentially introduce the resin fine particle L2 suitable for the pressure at that time.

In step d), carbon dioxide is introduced into the pressure container, to pressurize the dispersion. In this way, the organic solvent in the droplet is extracted into the dispersion medium.

The pressure inside the pressure container is preferably higher by 1.0 MPa or more, and more preferably by 3.0 MPa or more than that in step b) in order to efficiently extract the organic solvent in the droplet into the dispersion medium. Furthermore, pressure under which the pressure container is filled with a liquid, i.e., the dispersion, is particularly preferable. On the other hand, the upper limit of the pressure is preferably 20.0 MPa or less, and more preferably 15.0 MPa or less from the industrial viewpoint. The pressure can be controlled by the amount of carbon dioxide introduced, and carbon dioxide can be introduced by using a high-pressure pump.

In step e), the toner particle is obtained by performing so-called solvent removal in which the organic solvent extracted into the dispersion medium is removed from the pressure container.

Examples of the method of removing the organic solvent extracted into the dispersion medium include:

(1) a method including pressurizing the inside of a pressure container with carbon dioxide, and thereafter circulating carbon dioxide for replacement while constantly maintaining the pressure inside the pressure container; and (2) a method including pressurizing the inside of a pressure container with carbon dioxide, thereafter opening the pressure container once to reduce pressure, and repeatedly pressurizing the inside of the pressure container and reducing pressure for replacement.

Replacement using carbon dioxide is inadequate and an organic solvent remains in the dispersion, which may cause the toner particle to re-dissolve or cause the toner particle to aggregate when the obtained toner particle is recovered.

Therefore, replacement using carbon dioxide can be carried out until the organic solvent has been completely removed. The amount of carbon dioxide used is preferably 1 time or more and 100 times or less, more preferably 1 time or more and 50 times or less, and still more preferably 1 time or more and 30 times or less, based on the volume of the dispersion.

When the toner particle is removed from the dispersion, the pressure inside the pressure container may be reduced. Although the pressure may be reduced at all once to normal temperature and normal pressure in this case, the pressure may also be reduced in a stepwise manner by providing multiple stages of containers for which pressure is independently controlled. The depressurization rate can be set to a range at which the toner particle does not foam. The organic solvent and carbon dioxide used in the present invention can be recycled.

Step d) in the method of producing a toner of the present invention pressurizes the inside of the pressure container by further introducing carbon dioxide into the pressure container in order to efficiently remove the solvent in step e), to positively extract the organic solvent in the droplet into the dispersion medium. Therefore, in steps after step c), both the compositions of the disperse phase and continuous phase fluctuate with respect to step b).

The fluctuations of the disperse phase and continuous phase between the droplet forming step (step b)) and the solvent removing step (step e)) need not be particularly considered in a dissolution suspension method as a large difference. The dissolution suspension method uses a conventional water-based medium for a dispersion medium and performs production in the vicinity of atmospheric pressure from first to last.

The present inventors focused attention on this point, and have considered changes in the compositions of the disperse phase and continuous phase between the steps in detail. As a result, it was clear that a carbon dioxide ratio in the continuous phase is particularly greatly increased with the introduction of carbon dioxide. The inventors found that the composition greatly fluctuates before the pressure container is filled with a liquid in step d), and the composition less fluctuates after the pressure container is filled with a liquid.

Based on this finding, the present inventors considered problems in the production of a toner according to a dissolution suspension method using carbon dioxide for a dispersion medium again. As a result, a toner having sharp particle size distribution could not necessarily be obtained by merely appropriately adjusting the resin composition of a resin fine particle used for a dissolution suspension method by a conventional water-based medium and merely applying the adjusted resin fine particle to a dissolution suspension method using carbon dioxide as a dispersion medium.

For example, suppose that the composition of the resin R1 constituting the resin fine particle L1 is designed so that the resin fine particle L1 is disposed at the interface between the disperse phase and the continuous phase in step b). Nevertheless, in steps after step c), the resin fine particle L1 may be buried on the disperse phase side with the increase in the carbon dioxide ratio in the continuous phase. In such a case, the dispersion stability of the droplets is impaired, which causes the aggregation of the droplets, and is thus considered to cause deterioration in the particle size distribution of the obtained toner particle.

Therefore, in order to perform the dissolution suspension method using carbon dioxide as a dispersion medium, the present inventors considered that the resin fine particle L1 disposed at the interface between the disperse phase and the continuous phase in step b) may be effectively combined with the resin fine particle L2 disposed at the interface between the disperse phase and the continuous phase in steps after step c). Therefore, the inventors considered that, with the increase in the carbon dioxide ratio in the continuous phase, the dispersion stability can be maintained also in steps after step c) in which the dispersion stability of the droplet by the resin fine particle L1 is impaired, which enables suppressing the aggregation of the droplets.

So, the present inventors focused attention on the SP value of the resin R2 constituting the resin fine particle L2 for the design of the resin fine particle L2. The SP value is also referred to as a solubility parameter. The SP value is a numerical value used as an index that indicates the amount of a substance dissolved in another substance. When a substance has an SP value closer to that of another substance, the substance has a high affinity with the other substance. When a substance has an SP value distant from that of another substance, the substance has a low affinity with the other substance. The deterioration in the dispersion stable ability of the resin fine particle L1 in steps after step c) is considered to be caused by the decrease in the SP value of the continuous phase with the increase in the ratio of carbon dioxide as a hydrophobic dispersion medium in the continuous phase. So, by introducing the resin fine particle L2 containing the resin R2 having a lower SP value than that of the resin R1 between steps b) and d), the maintenance of the dispersion stability is expected to be allowed also in steps after step c) in which the dispersion stable ability of the resin fine particle L1 deteriorates. The inventors found that, by setting the relation of the SP values of the resin R1 and resin R2 to a specific range, the dispersion stability of the droplet with respect to composition fluctuation of the continuous phase can be maintained, and the aggregation of the droplets can be suppressed. These findings led to the creation of the present invention. Hereinafter, the details will be described.

In order to maintain the dispersion stability of the droplet in steps after step d) in which a carbon dioxide ratio in the continuous phase is higher than that of step b), the resin R2 needs to have a lower SP value than that of the resin R1. At this time, when the SP value difference is too large, the affinity between the resin fine particle L2 and the resin fine particle L1 becomes low, and the resin fine particle L2 is not adsorbed to the droplet. Even when the resin fine particle L2 is adsorbed, the resin fine particle L2 is apt to be easily separated.

The SP values of the resin R1 and resin R2 are respectively defined as SP (R1) $[(J/cm^3)^{1/2}]$ and SP (R2) $[(J/cm^3)^{1/2}]$. SP (R1) and SP (R2) satisfy the following formula (1).

$$2.0 \leq (SP(R1)-SP(R2))/SP(R1) \times 100 \leq 15.0 \quad (1)$$

Hereinafter, the relation of the SP values of the resin R1 and resin R2 in the formula (1):

$$[(SP(R1)-SP(R2))/SP(R1) \times 100]$$

is represented by f (SP).

f (SP) is a value obtained by standardizing the SP value difference between the resin R1 and the resin R2 with the SP value of the resin R1. f (SP) serves as an index for the resin fine particle L2 suppressing the aggregation of the droplets in steps after step c) after the droplet is formed by the resin fine particle L1 in step b). The reason why f (SP) is standardized by SP (R1) without simply specifying the difference between SP (R1) and SP (R2) is that the SP value difference between the resin R1 and the resin R2 suitable for suppressing the aggregation of the droplets is changed by the SP (R1) value.

When the SP value of the continuous phase in step b) is low, for example, the resin fine particle L1 having low SP (R1) is suitable for the formation of the droplet. In this case, since the decreasing width of the SP value of the continuous phase in steps after step c), particularly until the pressure container is filled with a liquid is decreased, the resin fine particle L2 containing the resin R2 having a small SP value difference from the resin R1 is suitable for suppressing the aggregation of the droplets. On the other hand, when the SP value of the continuous phase in step b) is high, the resin fine particle L1 having high SP (R1) is suitable for the formation of the droplet. In this case, since the decreasing width of the SP value of the continuous phase in steps after step c), particularly until the pressure container is filled with a liquid is increased, the resin fine particle L2 containing the resin R2 having a large SP value difference from the resin R1 is suitable for suppressing the aggregation of the droplets. That is, by decreasing [SP (R1)−SP (R2)] when SP (R1) is decreased, and by increasing [SP (R1)−SP (R2)] when SP (R1) is increased, an effect of combining the resin fine particle L1 with the resin fine particle L2 is exhibited. Therefore, in order to obtain a toner having sharp particle size distribution and a high circularity, it is important to set the f (SP) value to a specific range. In the present invention, the f (SP) value is 2.0 or more and 15.0 or less, and preferably 4.0 or more and 13.0 or less.

The f (SP) value of less than 2.0 means that the SP (R2) value is too close to SP (R1). In this case, the resin fine particle L2 cannot be adapted for the composition fluctuation of the continuous phase and the function as the dispersant deteriorates in steps after step c), which causes the aggregation of the droplets and a variant toner.

The f (SP) value of more than 15.0 means that the SP (R2) value is excessively distant from SP (R1). In this case, the affinity between the resin R1 and the resin R2 becomes low, and the resin fine particle L2 is not adsorbed to the droplet. As a result, the dispersion stability of the droplet deteriorates, which causes the broad particle size distribution of the toner.

SP (R1) $[(J/cm^3)^{1/2}]$ is preferably 16.0 or more and 19.0 or less. When the SP (R1) value is within this range, the affinity between the resin fine particle L1 and the resin solution in step b) can be maintained, and a stable droplet can be formed, which is more preferable. The SP (R1) value is more preferably 17.0 or more and 18.0 or less. SP (R2) $[(J/cm^3)^{1/2}]$ is preferably 14.0 or more and 17.0 or less. When the SP (R2) value is within this range, the resin fine particle L2 can be stably and continuously present at the interface between the disperse phase and the continuous phase in steps after step c), which is more preferable. The SP (R2) value is more preferably 15.0 or more and 16.0 or less.

The resin R1 and the resin R2 can contain a segment having an organopolysiloxane structure (hereinafter, also referred to as an organopolysiloxane group).

The organopolysiloxane group has a repetition unit of Si—O bond represented by the following formula (i), has a structure in which two alkyl groups are bonded to each Si element, and has a low SP value. Therefore, the organopolysiloxane group has an affinity with a continuous phase containing carbon dioxide as a hydrophobic dispersion medium.

Fomula (i)

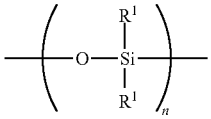

In the formula (i), $R^1$ is an alkyl group; and n represents a degree of polymerization, and is an integer of 2 or more.

The Si—O bond has a longer distance between bonds than that of C—C bond, and has higher flexibility. Therefore, when an organopolysiloxane group is introduced into the resin R1 and the resin R2, the organopolysiloxane group present on the surface of the resin fine particle is oriented on the continuous phase side, which can exhibit a so-called "excluded volume effect" preventing the aggregation caused by the collision of the droplets of the resin solution as the disperse phase.

In the method of producing a toner of the present invention, when the amounts of Si measured by the fluorescent X-ray analysis (XRF) of the resin R1 and resin R2 are respectively defined as X1 and X2, X1 and X2 preferably satisfy the following formula (2).

$$1.2 \leq X2/X1 \leq 3.0 \quad (2)$$

In order to satisfy the relation formula (1), SP (R2) as the SP value of the resin R2 needs to be smaller than SP (R1) as the SP value of the resin R1. Therefore, the resin R2 must contain a larger amount of Si than that of the resin R1.

When the X2/X1 value is 1.2 or more, the resin fine particle L2 sufficiently provides a dispersion stabilizing effect with respect to the composition fluctuation of the continuous phase, which can suppress the aggregation of the droplets in steps after step c), thereby allowing the generation of the variant toner to be further suppressed. When the X2/X1 value is 3.0 or less, the affinity of the resin fine particle L2 with the continuous phase is not too high, and thereby the resin fine particle L2 is likely to be adsorbed to the droplet, which can sufficiently maintain the effect of retaining the function as the dispersant also with respect to the composition fluctuation of the continuous phase. More preferably, the X2/X1 value is 1.4 or more and 2.5 or less.

When the amount of Si derived from the segment having the organopolysiloxane structure of the resin R1 measured by the X-ray photoelectron spectroscopy analysis (ESCA) of the resin fine particle L1 is defined as A1 (atomic %), A1 preferably satisfies the following formula (3)

$$3.0 \leq A1 \leq 6.0 \quad (3)$$

In ESCA, elements present on the surface of the sample (region between the outermost surface and a position located at a depth of approximately 10 nm) are detected. By chemical shift, the bond state of the element can also be separated. In the case of the Si—O bond derived from the organopolysiloxane group, a peak appears at 101 eV or more and 103 eV or less.

When the A1 value is 3.0 atomic % or more, a segment containing an organopolysiloxane group functioning as an affinity group with respect to carbon dioxide is sufficiently present, and sufficiently functions as a dispersant in step b), and the dispersion stability of the droplet can be maintained, which is more preferable. When the A1 value is 6.0 atomic % or less, the segment containing the organopolysiloxane group is not excessive, and the dispersion stability of the droplet can be maintained without reducing the affinity with the droplet, which is more preferable.

More preferably, the A1 value is 3.5 atomic % or more and 5.5 atomic % or less.

The present inventors subjected the resin fine particle L1 to an exposure treatment using carbon dioxide in a liquid state, and considered the surface composition of the resin fine particle L1 subjected to the exposure treatment.

Herein, specifically, in the exposure treatment, the dispersion in which the resin fine particle L1 is dispersed in the organic solvent is placed into the pressure container, and carbon dioxide is introduced into the pressure container. The organic solvent is removed from the dispersion by flowing carbon dioxide through the pressure container while maintaining a temperature at 25° C. and internal pressure at 6.5 MPa. Therefore, the surface of the resin fine particle L1 can be artificially in the same state as that after all the steps are performed in the producing method of the present invention. Herein, the amount of Si measured by ESCA of a treated resin fine particle L1 obtained by subjecting the resin fine particle L1 to the exposure treatment using carbon dioxide in a liquid state is defined as B1 (atomic %). That is, B1 represents the amount of Si derived from the segment having the organopolysiloxane structure of the resin R1 on the surface of the resin fine particle L1 after all the steps are performed in the producing method of the present invention, and serves as an index of the dispersion stable ability in step b).

The degree of change in the surface composition by the exposure treatment in the resin fine particle L1 is represented by B1/A1, and preferably satisfies the following formula (4). B1/A1 represents the latitude of the dispersion stable ability of the resin fine particle L1 to the composition fluctuation of the continuous phase in step b).

$$B1/A1 \geq 1.10 \quad (4)$$

B1/A1 value of 1.10 or more represents the large latitude of the dispersion stable ability of the resin fine particle L1 to the composition fluctuation of the continuous phase. For this reason, the value is preferably 1.10 or more in order to adjust the particle size of the droplet. More preferably, B1/A1 is 1.15 or more.

Furthermore, the present inventors subjected also the resin fine particle L2 to the same exposure treatment, and considered the surface composition of the resin fine particle L2 subjected to the exposure treatment.

Herein, the amount of Si measured by ESCA of a treated resin fine particle L2 obtained by subjecting the resin fine particle L2 to the exposure treatment using carbon dioxide in a liquid state is defined as B2 (atomic %). That is, B2 represents the amount of Si derived from the segment having the organopolysiloxane structure of the resin R2 on the surface of the resin fine particle L2 after all the steps are performed in the producing method of the present invention, and serves as an index of the dispersion stable ability in steps after step c).

The ratio between surface compositions of the resin fine particle L1 and resin fine particle L2 subjected to the exposure treatment is represented by B2/B1, and preferably satisfies the following formula (5). B2/B1 represents the composition difference of the continuous phase which can maintain the dispersion stability of the resin fine particle L1 and resin fine particle L2.

$$B2/B1 \leq 1.10 \quad (5)$$

The B2/B1 value of 1.10 or more means that the segment containing the organopolysiloxane group required for the maintenance of the dispersion stability in steps after step c) is sufficiently present on the surface of the resin fine particle L2. Therefore, since the value of 1.10 or more can sufficiently maintain the effect of retaining the function as the dispersant also with respect to the composition fluctuation of the continuous phase, the aggregation of the droplets can be suppressed, and a variant toner is not provided, which are more preferable. More preferably, B2/B1 is 1.15 or more.

B2 (atomic %) preferably satisfies the following formula (6).

$$6.0 \leq B2 \leq 10.0 \quad (6)$$

When the B2 value is 6.0 atomic % or more, the segment containing the organopolysiloxane group required for the maintenance of the dispersion stability in steps after step c) is sufficiently present on the surface of the resin fine particle L2, and the effect of retaining the function as the dispersant can be sufficiently maintained also with respect to the composition fluctuation of the continuous phase, which is more preferable. When the Si value is 10.0 atomic % or less, the excessive segment containing the organopolysiloxane group on the surface of the resin fine particle L2 is suppressed; the affinity with the continuous phase is not too high; and the resin fine particle L2 is likely to be adsorbed to the droplet. Therefore, the effect of retaining the function as the dispersant can be sufficiently maintained also with respect to the composition fluctuation of the continuous phase. As a result, in any case, the aggregation of the droplets can be effectively suppressed, which can further suppress the generation of a variant toner. Therefore, B2 is preferably 6.0 atomic % or more and 10.0 atomic % or less, and more preferably 6.5 atomic % or more and 9.5 atomic % or less.

The resin containing the segment having the organopolysiloxane structure in the resin R1 and the resin R2 can have a molecular structure having a side chain structure bonded at one terminal. The flexibility of the segment having the organopolysiloxane structure in a structure in which one terminal is bonded is higher than that in a structure in which both terminals are bonded, which provides an improvement in an excluded volume effect. In order to achieve the improvement, the resin R1 and the resin R2 are preferably obtained by polymerizing a monomer composition containing an organopolysiloxane compound having a vinyl group. Furthermore, the resin R1 and the resin R2 are more preferably obtained by polymerizing a monomer composition containing a polyester having a polymerizable unsaturated group in addition to an organopolysiloxane compound having a vinyl group.

In the resin R1 and the resin R2, the segment derived from the organopolysiloxane compound having a vinyl group exhibits a high affinity with carbon dioxide as a dispersion medium, and can exhibit an excluded volume effect. On the other hand, since the segment derived from the polyester having a polymerizable unsaturated group has a high affinity with the binder resin containing a polyester, the segment functions as a component adsorbed to the droplet of the resin solution. Therefore, the stability of the droplet can be further improved by using the resin fine particle containing the resin having both the segments as the dispersant. The sharper particle size distribution and higher circularity of the toner particle can be achieved.

An example of the structure of the organopolysiloxane compound having a vinyl group used for polymerizing the resin R1 and the resin R2 is shown in a formula (ii). In the formula (ii), $R^2$ and $R^3$ are alkyl groups; $R^4$ is an alkylene group; and $R^5$ is a hydrogen atom or a methyl group. n represents a degree of polymerization, and is an integer of 2 or more.

Formula (ii)

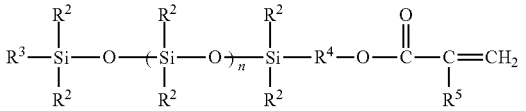

Examples of a method of synthesizing the organopolysiloxane compound having a vinyl group include a reaction involving a dehydrochlorination between a carbinol-modified polysiloxane and acrylic acid chloride or methacrylic acid chloride.

Examples of a method of producing the polyester having a polymerizable unsaturated group include the following.

(1) A method including introducing a polymerizable unsaturated group during the polycondensation reaction of a dicarboxylic acid and diol. Examples of the method including introducing the polymerizable unsaturated group include:

(1-1) a method including using a dicarboxylic acid having a polymerizable unsaturated group for part of a dicarboxylic acid;

(1-2) a method including using a diol having a polymerizable unsaturated group for part of a diol; and (1-3) a method including respectively using a dicarboxylic acid having a polymerizable unsaturated group and a diol having a polymerizable unsaturated group for part of a dicarboxylic acid and part of a diol.

Examples of the dicarboxylic acids having a polymerizable unsaturated group include fumaric acid, maleic acid, 3-hexenedioic acid and 3-octenedioic acid. In addition, examples also include lower alkyl esters and acid anhydrides thereof. Among these acids, fumaric acid and maleic acid are more preferable in terms of cost. Examples of aliphatic diols having a polymerizable unsaturated group include: 2-butene-1,4-diol, 3-hexene-1,6-diol and 4-octene-1,8-diol.

As a dicarboxylic acid or diol having no polymerizable unsaturated group, a dicarboxylic acid or diol which is used for producing a usual polyester to be described below can be used.

(2) A method including coupling a polyester produced by the polycondensation of a dicarboxylic acid and diol with a vinyl-based compound.

In the coupling reaction, the polyester may be directly coupled with a vinyl-based compound containing a functional group capable of reacting with a terminal functional group of the polyester. The polyester may be coupled with a vinyl-based compound by modifying the terminal of the polyester using a linker so that the terminal can be reacted with a functional group contained in the vinyl-based compound. Examples thereof include the following methods:

(2-1) a method including coupling a polyester having a carboxyl group at the terminal thereof with a vinyl-based compound containing a hydroxyl group during a condensation reaction.

In this case, the molar ratio of the dicarboxylic acid to the diol (dicarboxylic acid/diol) can be 1.02 or more and 1.20 or less in the preparation of the polyester.

(2-2) a method including coupling a polyester having a hydroxyl group at the terminal thereof with a vinyl-based compound having an isocyanate group during a urethanation reaction.

(2-3) a method including coupling a polyester having a hydroxyl group at the terminal thereof with a vinyl-based compound having a hydroxyl group during a urethanation reaction using diisocyanate as a linker.

The molar ratio of the diol to the dicarboxylic acid (diol/dicarboxylic acid) can be 1.02 or more and 1.20 or less in the preparation of the polyester used in the methods (2-2) and (2-3).

Examples of the vinyl-based compound having a hydroxyl group include hydroxystyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-butene-3-ol, 2-butene-1-ol, 2-butene-1,4-diol, propargyl alcohol, 2-hydroxyethyl propenyl ether and sucrose allyl ether. Among these compounds, hydroxyethyl acrylate and hydroxyethyl methacrylate are preferable.

Examples of the vinyl-based compound having an isocyanate group include: 2-isocyanatoethyl acrylate, 2-isocyanatoethyl methacrylate, methacrylic acid 2-(0-[1'-methylpropylideneamino]carboxyamino)ethyl, 2-[(3,5-dimethylpyrazolyl)carbonylamino]ethyl methacrylate and m-isopropenyl-α,α-dimethylbenzyl isocyanate. Among these compounds, 2-isocyanatoethyl acrylate and 2-isocyanatoethyl methacrylate are particularly preferable.

Examples of the diisocyanate include: aromatic diisocyanates having 6 or more and 20 or less carbon atoms (excluding the carbon in the NCO group; the same applies in the following), aliphatic diisocyanates having 2 or more and 18 or less carbon atoms, alicyclic diisocyanates having 4 or more and 15 or less carbon atoms, a modified substance of these diisocyanates (urethane group-, carbodiimide group-, allophanate group-, urea group-, biuret group-, uretdione group-, uretimine group-, isocyanurate group- and oxazolidone group-containing modified substances, hereafter also referred to as modified diisocyanates).

Examples of the aromatic diisocyanate include: m- and/or p-xylylene diisocyanate (XDI) and α,α,α',α'-tetramethylxylylene diisocyanate.

Examples of the aliphatic diisocyanate include: ethylene diisocyanate, tetramethylene diisocyanate, hexamethylene diisocyanate (HDI) and dodecamethylene diisocyanate.

Examples of the alicyclic diisocyanate include: isophorone diisocyanate (IPDI), dicyclohexylmethane-4,4'-diisocyanate, cyclohexylene diisocyanate and methylcyclohexylene diisocyanate.

Among these diisocyanates, XDI, HDI and IPDI are preferable.

In the resin R1, the mass ratio (E1/S1) of the polyester having a polymerizable unsaturated group (E1) to the organopolysiloxane compound having a vinyl group (S1) can be 1.0 or more and 2.3 or less.

When the mass ratio (E1/S1) is 1.0 or more, the amount of the segment having the organopolysiloxane structure contained in the resin fine particle L1 is decreased in step b), and the affinity with the droplet of the resin solution is improved to improve the dispersion stability of the droplet.

When the mass ratio (E1/S1) is 2.3 or less, the amount of the segment having the organopolysiloxane structure contained in the resin fine particle L1 is increased in step b), and the affinity with carbon dioxide as a dispersion medium is improved, which improves the function as the dispersant of the resin fine particle L1 to provide a further improvement in the dispersion stability of the droplet.

The sum (E1+S1) of the organopolysiloxane compound having a vinyl group and the polyester having a polymerizable unsaturated group in the resin R1 can be 45.0% by mass or more and 90.0% by mass or less based on the total amount of the monomer composition used for the resin R1.

When the sum (E1+S1) of the organopolysiloxane compound having a vinyl group and the polyester having a polymerizable unsaturated group is 45.0% by mass or more, the affinity with both carbon dioxide as a dispersion medium and the droplet of the resin solution is improved, thereby improving the dispersion stability of the droplet, which is more preferable. When the sum (E1+S1) is 90.0% by mass or less, the stability as the resin is likely to be maintained under the presence of other monomers required in order to form the skeleton of the resin, which is more preferable.

In the resin R2, the mass ratio (E2/S2) of the polyester having a polymerizable unsaturated group (E2) to the organopolysiloxane compound having a vinyl group (S2) can be 0.5 or more and 1.8 or less.

When the mass ratio (E2/S2) is 0.5 or more, the amount of the segment having the organopolysiloxane structure contained in the resin fine particle L2 is decreased in steps after step c); the resin fine particle L2 is likely to be adsorbed to the droplet; and the dispersion stability of the droplet in steps after step c) can be maintained, which is more preferable.

When the mass ratio (E2/S2) is 1.8 or less, the amount of the segment having the organopolysiloxane structure contained in the resin fine particle L2 is increased in steps after step c), and the affinity with carbon dioxide as a medium is improved. As a result, adaptation to the composition fluctuation in steps after step c) is possible, and the effect of retaining the function as the dispersant can be maintained, which is more preferable.

The sum (E2+S2) of the organopolysiloxane compound having a vinyl group and the polyester having a polymerizable unsaturated group in the resin R2 can be 65.0% by mass or more and 90.0% by mass or less based on the total amount of the monomer composition used for the resin R2.

When the sum (E2+S2) of the organopolysiloxane compound having a vinyl group and the polyester having a polymerizable unsaturated group is 65.0% by mass or more, the affinity with the continuous phase and disperse phase having a fluctuating composition in steps after step c) is improved, and thereby the dispersion stability of the droplet can be maintained. When the sum (E2+S2) is 90.0% by mass or less, the stability as the resin is likely to be maintained under the presence of other monomers required in order to form the skeleton of the resin, which is more preferable.

The weight-average molecular weight (Mw) of the organopolysiloxane compound having a vinyl group in the resin R1 can be 400 or more and 2,000 or less. When the Mw value is within the above range, the dispersion stability of the droplet is improved, which can provide the sharp particle size distribution and high circularity of the toner particle.

When the Mw value is 400 or more, the segment having the organopolysiloxane structure is widely aligned on the continuous phase side. Therefore, an excluded volume effect is sufficiently obtained, which is more preferable.

When the Mw value is 2,000 or less, a side chain having the organopolysiloxane structure is not excessively lengthened, thereby causing no deterioration in solvent resistance as the resin to suppress the deterioration in the stability of the droplet, which is more preferable.

The weight-average molecular weight (Mw) of the organopolysiloxane compound having a vinyl group in the resin R2 can be 400 or more and 2,000 or less. When the Mw value is within the above range, the dispersion stability of the droplet can be maintained in steps after step c), which enables suppressing the aggregation of the droplets.

When the Mw value is 400 or more, the segment having the organopolysiloxane structure is widely aligned on the continuous phase side. Therefore, an excluded volume effect is sufficiently obtained, which is more preferable. When the Mw value is 2,000 or less, a side chain having the organopolysiloxane structure is not excessively lengthened, thereby causing no deterioration in solvent resistance as the resin, and providing the maintenance of the stability of the droplet in steps after step c), which is more preferable.

Other monomers can be polymerized in addition to the organopolysiloxane compound having a vinyl group and the polyester having a polymerizable unsaturated group in order to polymerize the resin R1 and the resin R2. Monomers used in the polymerization of a usual resin material can be used as the other monomers. Examples thereof include, but are not limited to:

aliphatic vinyl hydrocarbons: alkenes, for example, ethylene, propylene, butene, isobutylene, pentene, heptene, diisobutylene, octene, dodecene, octadecene and α-olefins other than those described above; and alkadienes, for example, butadiene, isoprene, 1,4-pentadiene, 1,6-hexadiene and 1,7-octadiene; alicyclic vinyl hydrocarbons: mono- or di-cycloalkenes and alkadienes, for example, cyclohexene, cyclopentadiene, vinylcyclohexene and ethylidene bicycloheptene; and terpenes, for example, pinene, limonene and indene; aromatic vinyl hydrocarbons: styrene and hydrocarbyl-(alkyl-, cycloalkyl-, aralkyl- and/or alkenyl-) substituted forms thereof, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene and trivinylbenzene; and vinylnaphthalene; carboxyl group-containing vinyl-based monomers and metal salts thereof: unsaturated monocarboxylic acids and unsaturated dicarboxylic acids having 3 or more and 30 or less carbon atoms, and anhydrides and monoalkyl (1 or more and 27 or less carbon atoms) esters thereof, for example, carboxyl group-containing vinyl-based monomers of acrylic acid, methacrylic acid, maleic acid, maleic anhydride, maleic acid monoalkyl esters, fumaric acid, fumaric acid monoalkyl esters, crotonic acid, itaconic acid, itaconic acid monoalkyl esters, itaconic acid glycol monoethers, citraconic acid, citraconic acid monoalkyl esters and cinnamic acid; vinyl esters: for example, vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate and ethyl α-ethoxyacrylate, alkyl acrylates and alkyl methacrylates having an alkyl group (linear or branched) having 1 or more and 11 or less carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, dialkyl fumarate (fumaric acid dialkyl ester) (the two alkyl groups are linear, branched chain or alicyclic groups having 2 or more and 8 or less carbon atoms), and dialkyl maleate (maleic acid dialkyl ester) (the two alkyl groups are linear, branched chain or alicyclic groups having 2 or more and 8 or less carbon atoms); polyallyloxyalkanes (diallyloxyethane, triallyloxyethane, tetraallyloxyethane, tetraallyloxypropane, tetraallyloxybutane and tetramethallyloxyethane); vinyl-based monomers having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol 10 mole ethylene oxide (hereinafter, ethylene oxide is abbreviated as EO) adduct acrylate, methyl alcohol 10 mole ethylene oxide (hereinafter, ethylene oxide is abbreviated as EO) adduct methacrylate, lauryl alcohol 30 mole EO adduct acrylate and lauryl alcohol 30 mole EO adduct methacrylate); and polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate and polyethylene glycol dimethacrylate).

The resin R1 and the resin R2 may have a crosslinked structure. General crosslinking agents having a plurality of vinyl groups can be used for the formation of the crosslinked structure.

Examples of the usable crosslinking agents include, but are not limited to:

diethylene glycol diacrylate, triethylene glycol diacrylate, tetraethylene glycol diacrylate, polyethylene glycol diacrylate, polypropylene diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, divinyl ether, both-end acrylic modified silicone and both-end methacrylic modified silicone.

A crosslinked structure can also be formed using a polyester having a polymerizable unsaturated group having a degree of unsaturation of 2.0 or more. The degree of unsaturation herein represents the average of the number of polymerizable unsaturated groups contained in one molecule. The degree of unsaturation of the polyester having a polymerizable unsaturated group can be adjusted by the amount of the dicarboxylic acid or diol having a polymerizable unsaturated group added.

The particle diameters of the resin fine particle L1 and resin fine particle L2 are preferably 30 nm or more and 300 nm or less in terms of the number-average particle diameter. More preferably, the particle diameters are 50 nm or more and 250 nm or less.

When the particle diameter of the resin fine particle L1 is within this range, the stability of the droplet in step b) is improved, which makes it easy to control the particle diameter of the droplet to a desired size. When the particle diameter of the resin fine particle L2 is within this range, the aggregation of the droplets in steps after step c) is further suppressed, and the resin fine particle L2 is likely to be adsorbed to the droplet.

When the amount (parts by mass) of the resin fine particle L1 based on 100 parts by mass of the binder resin is defined as M1, M1 preferably satisfies the following formula (7).

$$1.0 \leq M1 \leq 10.0 \quad (7)$$

When M1 is 1.0 part by mass or more, the stability of the droplet in step b) can be maintained, which is more preferable. On the other hand, when M1 is 10.0 parts by mass or less, the particle diameter of the droplet is likely to be controlled to a desired size, which is more preferable. More preferably, M1 is 3.0 parts by mass or more and 10.0 parts by mass or less.

When the amount (parts by mass) of the resin fine particle L2 based on 100.0 parts by mass of the binder resin is defined as M2, M2 preferably satisfies the following formula (8).

$$1.0 \leq M2 \leq 10.0 \quad (8)$$

When M2 is 1.0 part by mass or more, the aggregation of the droplets in steps after step c) is further suppressed. On the other hand, when M2 is 10.0 parts by mass or less, the stability of the droplet formed in step b) is not impaired by the resin fine particle L2, and the particle size distribution can be satisfactorily maintained, which are more preferable. More preferably, M2 is 1.0 part by mass or more and 5.0 parts by mass or less.

Furthermore, M1 and M2 can satisfy the following formula (9).

$$M1 \geq M2 \quad (9)$$

When the formula (9) is satisfied, the stability of the droplet formed in step b) can be maintained, and the particle size distribution can be satisfactorily maintained, which are more preferable.

In the method of producing a toner of the present invention, the binder resin can have a higher SP value than that of the resin R1. In step b), in order to stably disperse the droplets by the resin fine particle L1, the resin fine particle L1 needs to be unevenly distributed at the interface between the droplet and the dispersion medium to suppress the coalescence and aggregation of the droplets. When carbon dioxide as a hydrophobic medium is used as a dispersion medium, the SP value is increased in order of the dispersion medium, resin R1 and droplet, and thereby the resin fine particles L1 can be unevenly distributed at the interface between the dispersion medium and the droplet. Therefore, the SP value of the binder resin constituting the droplet can be higher than that of the resin R1.

The SP $[(J/cm^3)^{1/2}]$ of the binder resin can be 17.0 or more and 23.0 or less.

As the binder resin, both a crystalline resin and an amorphous resin as resins generally used for a toner can be used. The crystalline resin means a resin having a structure in which molecular chains of a polymer are regularly arranged. Therefore, the crystalline resin hardly softens in a temperature range lower than a melting point, while the resin starts to melt and softens very rapidly over the vicinity of the melting point. Such a resin exhibits a clear melting point peak in differential scanning calorimetric measurements using a differential scanning calorimeter (DSC). Therefore, the crystalline resin is likely to exhibit good low-temperature fixability due to the low post-melting viscosity thereof.

The melting point of the crystalline resin can be 50° C. or more and 90° C. or less.

Examples of the crystalline resin which can be used for the binder resin include a crystalline polyester resin, a crystalline polyvinyl resin, a crystalline polyurethane resin and a crystalline polyurea resin. The crystalline resin is preferably a crystalline polyester resin and a crystalline polyvinyl resin, and particularly preferably a crystalline polyester resin.

The crystalline polyester resin is preferably obtained by reacting an aliphatic diol with an aliphatic dicarboxylic acid, and more preferably obtained by reacting an aliphatic diol having 2 to 20 carbon atoms with an aliphatic dicarboxylic acid having 2 to 20 carbon atoms.

The aliphatic diol is preferably of the linear type. As a result of being of the linear type, a polyester is obtained which has a higher degree of crystallinity. Examples of the linear type aliphatic diols having 2 to 20 carbon atoms include: 1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. Among these compounds, 1,4-butanediol, 1,5-pentanediol, 1,6-hexanediol, 1,7-heptanediol, 1,8-octanediol, 1,9-nonanediol and 1,10-decanediol are more preferable from the viewpoint of melting point. These compounds may be used singly or two or more can be used as a mixture.

Aliphatic diols having a polymerizable unsaturated group can also be used. Examples of the aliphatic diols having a polymerizable unsaturated group include: 2-butene-1,4-diol, 3-hexene-1,6-diol and 4-octene-1,8-diol.

The aliphatic dicarboxylic acid is particularly preferably a linear type aliphatic dicarboxylic acid from the viewpoint of crystallinity. Examples of the above-mentioned linear type aliphatic dicarboxylic acid having 2 to 18 carbon atoms include: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid and lower alkyl esters and acid anhydrides thereof. Among these compounds, sebacic acid, adipic acid, 1,10-decanedicarboxylic acid and lower alkyl esters and acid anhydrides thereof are preferable. These compounds may be used singly or two or more can be used as a mixture.

Aromatic carboxylic acids can also be used. Examples of aromatic dicarboxylic acids include: terephthalic acid, isophthalic acid, 2,6-naphthalenedicarboxylic acid and 4,4'-biphenyldicarboxylic acid. Among these compounds, terephthalic acid is preferable in respect of the availability and ease of forming polymers having a low melting point.

A dicarboxylic acid having a polymerizable unsaturated group can also be used. The dicarboxylic acid having a polymerizable unsaturated group can be used suitably to suppress hot offset during fixation since the entire resin can be crosslinked by utilizing the polymerizable unsaturated group. Examples of such dicarboxylic acids include fumaric acid, maleic acid, 3-hexenedioic acid and 3-octenedioic acid. Examples also include lower alkyl esters and acid anhydrides thereof. Among these acids, fumaric acid and maleic acid are more preferable in terms of cost.

A method of producing the crystalline polyester resin is not particularly limited, and the crystalline polyester resin can be produced by polymerizing a typical polyester resin obtained by reacting a carboxylic acid component and an alcohol component. For example, a direct polycondensation method or a transesterification method can be used, and these methods can be used according to the kind of monomer.

The crystalline polyester resin can be produced at polymerization temperatures of 180° C. or more and 230° C. or less. Pressure inside the reaction system may be reduced as necessary, and the reaction can be carried out while water and alcohol generated during condensation are removed. When the monomer does not dissolve or is not compatible at the reaction temperature, the monomer may be dissolved by adding a high-boiling point organic solvent as a solubilizing agent. The polycondensation reaction is carried out while the solubilizing agent is removed.

Examples of catalysts which can be used during the production of the crystalline polyester resin include: titanium catalysts such as titanium tetraethoxide, titanium tetrapropoxide, titanium tetraisopropoxide and titanium tetrabutoxide, and tin catalysts such as dibutyltin dichloride, dibutyltin oxide and diphenyltin oxide.

Examples of crystalline polyvinyl resins include resins obtained by polymerizing a vinyl-based monomer containing a linear type alkyl group in the molecular structure thereof.

The vinyl-based monomer containing a linear type alkyl group in the molecular structure thereof can be an alkyl acrylate or alkyl methacrylate in which the number of carbon atoms of the alkyl group is 12 or more, and examples thereof include: lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate and behenyl methacrylate.

In the method of producing a crystalline polyvinyl resin, polymerization can be carried out at a temperature of 40° C. or more, typically 50° C. or more and 90° C. or less.

The amorphous resin does not demonstrate a well-defined maximum endothermic peak in differential scanning calorimetric measurements. However, the glass transition temperature (Tg) of the amorphous resin is preferably 50° C. or more and 130° C. or less, and more preferably 55° C. or more and 110° C. or less.

Specific examples of the amorphous resins include an amorphous polyester resin, a polyurethane resin, a polyvinyl resin and a polyurea resin. These resins may be modified with urethane, urea or epoxy. Among these resins, the amorphous polyester resin, the polyurethane resin and the polyvinyl resin are suitable from the viewpoint of maintaining elasticity, and the amorphous polyester resin is particularly suitable.

Hereinafter, the amorphous polyester resin will be described. Examples of monomers which can be used in the production of the amorphous polyester resins include conventionally known divalent or higher carboxylic acids and divalent or higher alcohols. Specific examples of these monomers include the following.

Examples of the divalent carboxylic acids include: dibasic acids such as succinic acid, adipic acid, sebacic acid, phthalic acid, isophthalic acid, terephthalic acid, malonic acid and dodecenylsuccinic acid, and anhydrides and lower alkyl esters thereof; and aliphatic unsaturated dicarboxylic acids such as maleic acid, fumaric acid, itaconic acid and citraconic acid.

Examples of trivalent or higher carboxylic acids include: 1,2,4-benzenetricarboxylic acid, 1,2,5-benzenetricarboxylic acid, and anhydrides and lower alkyl esters thereof. These compounds may be used singly or in combinations of two or more.

Examples of dihydric alcohols include: alkylene glycols (ethylene glycol, 1,2-propylene glycol and 1,3-propylene glycol); alkylene ether glycols (polyethylene glycol and polypropylene glycol); alicyclic diols (1,4-cyclohexanedimethanol); bisphenols (bisphenol A); and alkylene oxide (ethylene oxide and propylene oxide) adducts of alicyclic diols.

The alkyl moiety of alkylene glycols and alkylene ether glycols may be linear or branched. Alkylene glycols having a branched structure can also be used in the present invention.

Examples of trihydric or higher alcohols include: glycerol, trimethylolethane, trimethylolpropane and pentaerythritol. These alcohols may be used singly or in combinations of two or more.

Monovalent acids such as acetic acid and benzoic acid, and monohydric alcohols such as cyclohexanol and benzyl alcohol can also be used as necessary for the purpose of adjusting acid value or hydroxyl value.

A method of synthesizing the amorphous polyester resin is not particularly limited, but for example, a transesterification method and a direct polycondensation method can be used singly or in combination.

Next, the amorphous polyurethane resin will be described. The polyurethane resin is the reaction product of a diol and a compound containing a diisocyanate group, and resins having various types of functionality can be obtained by adjusting the diol and diisocyanate.

Ones similar to diisocyanates which can be used for producing the polyester having a polymerizable unsaturated group can be used as the diisocyanate.

Isocyanate compounds having a functionality of 3 or more in addition to the diisocyanate can also be used.

Ones similar to dihydric alcohols which can be used for producing the amorphous polyester can be employed as the diol.

Hereinafter, the amorphous vinyl resin will be described. Examples of monomers which can be used in the production of the amorphous vinyl resin include the following compounds:

aliphatic vinyl hydrocarbons: alkenes (ethylene, propylene, butene, isobutylene, pentene, heptene, diisobutylene, octene, dodecene, octadecene and α-olefins other than those described above); alkadienes (butadiene, isoprene, 1,4-pentadiene, 1,6-hexadiene and 1,7-octadiene); alicyclic vinyl hydrocarbons: mono- or di-cycloalkenes and alkadienes (cyclohexene, cyclopentadiene, vinylcyclohexene and ethylidene bicycloheptene); and terpenes (pinene, limonene and indene); aromatic vinyl hydrocarbons: styrene and hydrocarbyl-(alkyl-, cycloalkyl-, aralkyl- and/or alkenyl-) substituted forms thereof (α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene and trivinylbenzene); and vinylnaphthalene; carboxyl group-containing vinyl monomers and metal salts thereof: unsaturated monocarboxylic acids and unsaturated dicarboxylic acids having 3 or more and 30 or less carbon atoms, and anhydrides thereof and monoalkyl [1 or more and 11 or less carbon atoms] esters thereof (carboxyl group-containing vinyl-based monomers of maleic acid, maleic anhydride, maleic acid monoalkyl esters, fumaric acid, fumaric acid monoalkyl esters, crotonic acid, itaconic acid, itaconic acid monoalkyl esters, itaconic acid glycol monoethers, citraconic acid, citraconic acid monoalkyl esters and cinnamic acid);

vinyl esters (vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate and ethyl α-ethoxyacrylate), alkyl acrylates and alkyl methacrylates having an alkyl group (linear or branched) having 1 or more and 11 or less carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, dialkyl fumarate (fumaric acid dialkyl ester) (the two alkyl groups are linear, branched chain or alicyclic groups having 2 or more and 8 or less carbon atoms), and dialkyl maleate (maleic acid dialkyl ester) (the two alkyl groups are linear, branched chain or alicyclic groups having 2 or more and 8 or less carbon atoms); polyallyloxyalkanes (diallyloxyethane, triallyloxyethane, tetraallyloxyethane, tetraallyloxypropane, tetraallyloxybutane and tetramethallyloxyethane); vinyl-based monomers having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol 10 mole ethylene oxide (hereinafter, ethylene oxide is abbreviated as EO) adduct acrylate, methyl alcohol 10 mole ethylene oxide (hereinafter, ethylene oxide is abbreviated as EO) adduct methacrylate, lauryl alcohol 30 mole EO adduct acrylate and lauryl alcohol 30 mole EO adduct methacrylate); and polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate and polyethylene glycol dimethacrylate).

Furthermore, in one of exemplary embodiments of the present invention, a block polymer in which a crystalline resin component is chemically bonded with an amorphous resin component is used as the binder resin.

Examples of the block polymer include a PQ diblock polymer, a PQP triblock polymer, a QPQ triblock polymer and a PQPQ . . . multiblock polymer, which include the crystalline resin component (P) and the amorphous resin component (Q). The block polymer to be used can be any type thereof.

The method of preparing the block polymer to be used can be a method in which the component that forms the crystalline resin is prepared separately from the component that forms the amorphous resin and the two are bonded (two-stage method), or a method in which the raw materials for the component that forms the crystalline resin and the component that forms the amorphous resin are simultaneously charged and preparation is performed at one time (single-stage method).

The block polymer can be made by selecting from various methods considering the reactivity of the respective terminal functional groups.

When both the crystalline resin component and the amorphous resin component are polyester resins, a block polymer can be prepared by separately preparing each component followed by linking using a linker as necessary. The components can be linked without using a linker particularly when the acid value of one of the polyesters is high while the hydroxyl value of the other polyester is high. The reaction temperature at this time can be in the vicinity of 200° C.

Examples of linkers used include: polyvalent carboxylic acids, polyhydric alcohols, polyvalent isocyanates, polyfunctional epoxies and polyvalent acid anhydrides. The use of these linkers enables synthesis by a dehydration reaction or addition reaction.

On the other hand, when the crystalline resin component is a polyester resin and the amorphous resin component is a polyurethane resin, a block polymer can be prepared by separately preparing each component followed by carrying out a urethanation reaction between the alcohol terminal of the polyester resin and the isocyanate terminal of the polyurethane resin. The block polymer can also be synthesized by mixing a polyester resin having an alcohol terminal with a diol and diisocyanate which compose the polyurethane resin followed by heating. Early in the reaction when the concentrations of the diol and diisocyanate are high, the diol and diisocyanate react selectively resulting in the formation of a polyurethane resin, and after the molecular weight has increased to a certain degree, a urethanation reaction occurs between the isocyanate terminal of the polyurethane resin and the alcohol terminal of the polyester resin, thereby allowing a block polymer to be obtained.

When both the crystalline resin component and the amorphous resin component are vinyl resins, the block polymer can be prepared by polymerizing one of the components followed by initiating polymerization of the other component from the end of the vinyl polymer.

The proportion of the crystalline resin component in the block polymer is preferably 50.0% by mass or more, and more preferably 70.0% by mass or more.

In one of exemplary embodiments of the present invention, the toner particle in the method of producing a toner contains a wax. Examples of the wax include, but are not limited to:

aliphatic hydrocarbon waxes such as low molecular weight polyethylene, low molecular weight polypropylene, low molecular weight olefin copolymer, microcrystalline wax, paraffin wax and Fischer-Tropsch wax; oxides of aliphatic hydrocarbon waxes such as oxidized polyethylene wax; waxes having, as a main component, fatty acid ester such as aliphatic hydrocarbon ester wax; waxes obtained by deoxidizing all or a portion of a fatty acid ester such as deoxidized carnauba wax; partial esterification products of fatty acids and polyhydric alcohols such as behenic acid monoglyceride; and methyl ester compounds having a hydroxyl group obtained by hydrogenating a vegetable oil.

Aliphatic hydrocarbon waxes and ester waxes are particularly preferred for use in the method of producing a toner of the present invention. The ester wax used in the present invention is preferably an ester wax having a functionality of 3 or more, more preferably an ester wax having a functionality of 4 or more, and particularly preferably an ester wax having a functionality of 6 or more.

The ester waxes having a functionality of 3 or more are obtained by, for example, the condensation of a trivalent or higher acid with a long-chain linear saturated alcohol, or by the synthesis of a trihydric or higher alcohol with a long-chain linear saturated fatty acid.

Examples of trihydric or higher alcohols which may be used in the wax include, but are not limited to, the following, which may also be used as a mixture in some cases: glycerol, trimethylolpropane, erythritol, pentaerythritol and sorbitol; and condensation products thereof, such as polyglycerols (e.g., diglycerol, triglycerol, tetraglycerol, hexaglycerol and decaglycerol) obtained by the condensation of glycerol, ditrimethylolpropane and tristrimethylolpropane obtained by the condensation of trimethylolpropane, and dipentaerythritol and tripentaerythritol obtained by the condensation of pentaerythritol. Of these alcohols, alcohols having a branched structure are preferred, pentaerythritol or dipentaerythritol is more preferred, and dipentaerythritol is particularly preferred.

The long-chain linear saturated fatty acids which can be used are represented by the general formula $C_nH_{2n+1}COOH$, wherein n is 5 or more and 28 or less.

Examples include, but are not limited to, the following, which may also be used as a mixture in some cases: caproic acid, caprylic acid, octylic acid, nonylic acid, decanoic acid, dodecanoic acid, lauric acid, tridecanoic acid, myristic acid, palmitic acid, stearic acid and behenic acid. Myristic acid, palmitic acid, stearic acid and behenic acid can be used from the standpoint of the melting point of the wax.

Examples of trivalent or higher acids which may be used in the present invention include, but are not limited to, the following, which may also be used as a mixture in some cases: trimellitic acid and butanetetracarboxylic acid.

The long-chain linear saturated alcohols which can be used are represented by $C_nH_{2n+1}OH$, wherein n is 5 or more and 28 or less.

Examples include, but are not limited to, the following, which may also be used as a mixture in some cases: capryl alcohol, lauryl alcohol, myristyl alcohol, palmityl alcohol, stearyl alcohol and behenyl alcohol. Myristyl alcohol, palmityl alcohol, stearyl alcohol and behenyl alcohol can be used from the standpoint of the melting point of the wax.

The content of the wax in the toner particle is preferably 1.0 part by mass or more and 20.0 parts by mass or less, and more preferably 2.0 parts by mass or more and 15.0 parts by mass or less based on 100 parts by mass of the binder resin.

The wax preferably has a maximum endothermic peak in the range of 60° C. or more and 120° C. or less, and more preferably in the range of 60° C. or more and 90° C. or less in differential scanning calorimeter (DSC) measurement.

The toner particle contains a colorant. Examples of the colorant which can be used in the present invention include an organic pigment, an organic dye, an inorganic pigment, carbon black as a black colorant, a magnetic particle, and other colorants conventionally used in the toner.

Examples of yellow colorants include a condensed azo compound, an isoindolinone compound, an anthraquinone compound, an azo metal complex, a methine compound and an allylamide compound. Specifically, C.I. Pigment Yellow 12, 13, 14, 15, 17, 62, 74, 83, 93, 94, 95, 109, 110, 111, 128, 129, 147, 155, 168 and 180 are suitably used.

Examples of magenta colorants include a condensed azo compound, a diketopyrrolopyrrole compound, anthraquinone, a quinacridone compound, a basic dye lake compound, a naphthol compound, a benzimidazolone compound, a thioindigo compound and a perylene compound.

Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 are suitably used.

Examples of cyan colorants include a copper phthalocyanine compound and a derivative thereof, an anthraquinone compound and a basic dye lake compound. Specifically, C.I. Pigment Blue 1, 7, 15, 15:1, 15:2, 15:3, 15:4, 60, 62 and 66 are suitably used.

The colorants used in the method of producing a toner of the present invention are selected from the viewpoints of hue angle, saturation, brightness, lightfastness, OHP transparency, and dispersibility in the toner.

Based on 100 parts by mass of the binder resin, 1.0 part by mass or more and 20.0 parts by mass or less of the colorant can be used. When the magnetic particle is used as the colorant, the amount thereof added can be 40.0 parts by mass or more and 150.0 parts by mass or less based on 100 parts by mass of the binder resin.

As necessary, the toner particle may contain a charge control agent. A charge control agent may also be externally added to the toner particle. The incorporation of the charge control agent can stabilize the charging characteristics and control the optimal amount of triboelectric charge in conformity to the development system.

A known charge control agent can be utilized, and in particular, a charge control agent which can increase the charging speed and can stably maintain a constant amount of charge is preferable.

Charge control agents which control the toner so as to have a negative chargeability can be exemplified as follows. An organometal compound and a chelate compound are effective. Examples thereof include a monoazo-metal compound, an acetylacetone-metal compound, and the metal compounds of an aromatic oxycarboxylic acid, aromatic dicarboxylic acid, oxycarboxylic acid and dicarboxylic acid. Examples of charge control agents which control the toner so as to have a positive chargeability include nigrosine, a quaternary ammonium salt, the metal salt of a higher fatty acid, diorganotin borates, a guanidine compound and an imidazole compound.

The content of the charge control agent is preferably 0.01 parts by mass or more and 20.0 parts by mass or less, and more preferably 0.5 parts by mass or more and 10.0 parts by mass or less based on 100 parts by mass of the binder resin.

In the method of producing a toner of the present invention, an inorganic fine particle can be added to the toner particle as a flowability improver. Examples of the inorganic fine particle added to the toner particle include fine particles such as a silica fine particle, a titanium oxide fine particle, an alumina fine particle, and a multiple oxide fine particle thereof. Among the inorganic fine particles, the silica fine particle and the titanium oxide fine particle are preferred.

Examples of the silica fine particle include the dry silica and fumed silica produced via the vapor-phase oxidation of a silicon halide, and the wet silica produced from water glass. Among these silica fine particles, the dry silica is preferred. The dry silica may be a composite fine particle of silica with another metal oxide, which is produced by using a combination of the silicon halide compound with a metal halide compound such as aluminum chloride or titanium chloride, in the production process.

The inorganic fine particle can be added externally to the toner particle in order to improve toner flowability and to uniformize toner charging. The regulation of the amount of charge of the toner and an improvement in the environment stability of the toner can be achieved by the hydrophobic treatment of the inorganic fine particle.

The weight-average particle diameter (D4) of the toner particle in the method of producing a toner of the present invention is preferably 3.0 μm or more and 8.0 μm or less, and more preferably 5.0 μm or more and 7.0 μm or less. The use of the toner particle having such a weight-average particle diameter (D4) is preferable in terms of ensuring favorable toner handling ability and sufficiently satisfying dot reproducibility. The ratio (D4/D1) of the weight-average particle diameter (D4) to the number-average particle diameter (D1) of the obtained toner particle can be less than 1.25.

The toner particle in the method of producing a toner of the present invention can have an average circularity of 0.97 or more. The average circularity is an index which indicates the unevenness of the surface of the toner particle. The value of the average circularity closer to 1 provides a more uniform surface having less unevenness, which enables externally adding various external additives having functions for applying charging properties to the toner to the surface of the toner particle uniformly.

Furthermore, the toner particle in the method of producing a toner of the present invention can have a circularity variation coefficient of less than 4.00. The circularity variation coefficient is an index which indicates the distribution of the circularity. The smaller value of the circularity variation coefficient provides a more uniform shape, which is less likely to cause poor cleaning in actual use.

Hereinafter, methods to measure the values of various physical properties defined in the present invention will be described.

<Method of Measuring Weight-Average Particle Diameter (D4) and Number-Average Particle Diameter (D1) of Toner Particle>

The weight-average particle diameter (D4) and number-average particle diameter (D1) of the toner particle are determined as follows. A precision particle size distribution measurement apparatus "Coulter Counter Multisizer 3" (registered trademark, manufactured by Beckman Coulter, Inc.) operating by the pore electrical resistance method and equipped with a 100 μm aperture tube is used as the measurement apparatus. The accompanying dedicated software "Beckman Coulter Multisizer 3 Version 3.51" (manufactured by Beckman Coulter, Inc.) is used to set the measurement conditions and analyze the measurement data. The measurements are performed at 25,000 channels for the number of effective measurement channels.

An aqueous electrolyte solution used for the measurements can be an aqueous electrolyte solution prepared by dissolving special-grade sodium chloride in ion-exchanged water to provide a concentration of approximately 1% by mass and, for example, "ISOTON II" (manufactured by Beckman Coulter, Inc.) can be used.

The dedicated software is set as follows prior to measurement and analysis.

In the "Change Standard Operating Method (SOM)" window of the dedicated software, the Total Count in the Control Mode is set to 50,000 particles; the Number of Runs is set to 1; and the Kd value is set to the value obtained using "Standard Particles 10.0 μm" (manufactured by Beckman Coulter, Inc.). The Threshold and the Noise Level are automatically set by pressing the "Threshold/Measure Noise Level." The current is set to 1,600 μA; the gain is set to 2; the electrolyte is set to ISOTON II; and the "Flush Aperture Tube After Each Run" is checked.

In the "Convert Pulses to Size Settings" window of the dedicated software, the bin spacing is set to Log Diameter; the Size Bins is set to 256 Size Bins; and the particle diameter range is set to 2 μm to 60 μm.

Specifically, the weight-average particle diameter (D4) and number-average particle diameter (D1) of the toner particle are measured by the method described in Japanese Patent Application Laid-Open No. 2012-042939.

<Method of Measuring Average Circularity and Circularity Variation Coefficient of Toner Particle>

The average circularity and circularity variation coefficient of the toner particle are measured under measurement and analysis conditions in calibration with a flow-type particle image analyzer "FPIA-3000" (manufactured by Sysmex Corporation).

The specific measurement method is as follows. First, approximately 20 mL of ion-exchanged water from which impure solid matters have been previously removed is placed into a glass container. Approximately 0.2 mL of a dispersant "Contaminon N" (10% by mass aqueous solution of a pH 7 neutral detergent for cleaning precision measuring instruments including a nonionic surfactant, an anionic surfactant and an organic builder, manufactured by Wako Pure Chemical Industries, Ltd.) is added thereto after diluting roughly 3-fold by mass with ion-exchanged water. Furthermore, approximately 0.02 g of the measurement specimen is added. The resultant is subjected to a dispersion treatment for 2 minutes using an ultrasonic disperser, to give a dispersion liquid for measurement. In this operation, cooling is performed as appropriate in such a manner that the temperature of the dispersion liquid is 10° C. or more and 40° C. or less. A desktop ultrasonic cleaner/disperser having an oscillation frequency of 50 kHz and an electrical output of 150 W (e.g., "VS-150" (manufactured by Velvo-Clear Co.)) is used as the ultrasonic disperser. A predetermined amount of ion-exchanged water is placed into a water tank, and approximately 2 mL of Contaminon N is added into the water tank.

For the measurement, the flow-type particle image analyzer provided with a regular objective lens (10-fold magnification) is used. For a sheath solution, a Particle Sheath "PSE-900A" (manufactured by Sysmex Corporation) is used. The dispersion liquid prepared according to the procedure is introduced into the flow-type particle image analyzer, and 3,000 toner particles are measured according to a total count mode in an HPF measurement mode. A binarization threshold during the particle analysis is set to 85% and the analyzed particle diameter is specified, and thereby the proportion (%) of the number of the particles in the range, and the average circularity can be determined. The average circularity and standard deviation of the toner particle having a circle-equivalent diameter of 1.985 μm or more and 200.00 μm or less are obtained. A variation coefficient is obtained from the values of the average circularity and standard deviation.

For the measurement, automatic focal point adjustment is performed before the start of the measurement using reference latex particles (e.g., diluting "RESEARCH AND TEST PARTICLES Latex Microsphere Suspensions 5200A" manufactured by Duke Scientific with ion-exchanged water). After the adjustment, focal point adjustment can be performed every 2 hours after the start of the measurement.

In Examples of the present application, a flow-type particle image analyzer which has been calibrated by Sysmex Corporation and has been issued with a calibration certificate by Sysmex Corporation is used. The measurement is performed under the same measurement and analysis conditions as the conditions when the calibration certificate has been received except that the analyzed particle diameter is limited to a circle-equivalent diameter of 1.985 μm or more and less than 200.00 μm.

<Method of Measuring Average of Number of Polymerizable Unsaturated Groups Contained in One Molecule of Polyester Having Polymerizable Unsaturated Groups>

The average of the number of polymerizable unsaturated groups contained in polyester having polymerizable unsaturated groups is measured by $^{1}$H-NMR under the following conditions:

Measurement apparatus: FT-NMR apparatus, JNM-EX400 (manufactured by JEOL Ltd.)
Measurement frequency: 400 MHz
Pulse condition: 5.0 μs
Frequency range: 10,500 Hz
Number of scans: 64
Measurement temperature: 30.0° C.

The sample is prepared by placing 50.0 mg of the polyester having polymerizable unsaturated groups into a sample tube with an inner diameter of 5.0 mm, adding deuterochloroform ($CDCl_3$) as a solvent, and dissolving in a thermostat bath at 40.0° C.

$^1$H-NMR of the sample is measured, to obtain peak information attributable to the following units:

(1) a unit Y1 derived from a compound containing a polymerizable unsaturated group;
(2) a unit Y2 derived from a diol containing no polymerizable unsaturated group; and
(3) a unit Y3 derived from a dicarboxylic acid containing no polymerizable unsaturated group.

The compound containing a polymerizable unsaturated group includes the diol having a polymerizable unsaturated group, the dicarboxylic acid containing a polymerizable unsaturated group, a vinyl-based compound having a hydroxyl group, and a vinyl-based compound having an isocyanate group.

A peculiar peak P1 which does not coincide with other units is selected from peaks attributable to the unit Y1, and the integrated value S1 of the selected peak P1 is determined.

A peculiar peak P2 which does not coincide with other units is selected from peaks attributable to the unit Y2, and the integrated value S2 of the selected peak P2 is determined.

A peculiar peak P3 which does not coincide with other units is selected from peaks attributable to the unit Y3, and the integrated value S3 of the selected peak P3 is determined.

The average of the number of polymerizable unsaturated groups contained in one molecule of the polyester having polymerizable unsaturated groups is obtained as follows using the integrated value S1, the integrated value S2 and the integrated value S3.

$$\text{Average of number of polymerizable unsaturated groups contained in one molecule of polyester having polymerizable unsaturated groups} = \{Mp \times (S1/n1)\}/\{M1 \times (S1/n1) + M2 \times (S2/n2) + M3 \times (S3/n3)\}$$

Also, n1, n2 and n3 are respectively the number of hydrogens in the units Y1, Y2 and Y3. M1, M2 and M3 are respectively the molecular weights of the units Y1, Y2 and Y3. Mp is the molecular weight of the polyester having a polymerizable unsaturated group.

<Method of Determining SP Value of Resin>

The SP value of the resin was obtained as follows using solubility parameter computational software (Hansen Solubility Parameters in Practice).

First, the SP value of a unit constituting a resin is obtained as follows. Herein, the unit constituting a resin means a molecular structure in a state where the double bond of a vinyl-based monomer is cleaved by polymerization when the resin is the vinyl-based resin (when a polymer constituting the resin is generated by the polymerization reaction of a vinyl-based monomer).

The SP value of Hansen of the unit is determined by inputting the molecular structure of the unit into the software according to the linear notation convention Smiles formula of a molecule, to automatically decompose the molecule into atom groups.

The SP value of the resin is determined by inputting the SP value of Hansen of the unit determined by the software and the mass ratio of each unit based on the amount charged into the software.

<Method of Measuring Amount of Si Contained in Resin by Fluorescent X-Ray Analysis (XRF)>

In the present invention, the amount of Si contained in the resin is measured as follows by fluorescent X-ray analysis (XRF). The resin fine particle is solidified in a pellet form. The atomic ratio of elements contained in the resin fine particle is measured by energy-dispersing character X-rays generated by the FP method under a He atmosphere using an Axios Advanced (manufactured by PANalytical B.V.) wavelength-dispersive X-ray fluorescence analyzer, to measure the amount of Si (% by mass) contained in the resin.

<Method of Measuring Amount of Si Present in Resin Fine Particle by X-Ray Photoelectron Spectroscopic Analysis (ESCA)>

In the present invention, the resin fine particle is subjected to an exposure treatment using carbon dioxide in a liquid state, and the amount of Si derived from the organopolysiloxane structure present in the resin fine particle before and after the treatment is determined by the analysis of the surface composition by ESCA.

The ESCA apparatus and measurement conditions are as follows.

Apparatus used: Quantum 2000 manufactured by ULVAC-PHI, Incorporated
Analysis method: narrow analysis
Measurement Conditions:
X-ray source: Al-Kα
X-ray conditions: 100μ, 25 W, 15 kV
Photoelectron incidence angle: 45°
Pass energy: 58.70 eV
Measurement range: ϕ100 μm The measurement is performed under the conditions described above and the peak derived from the C—C bond of carbon 1s orbit is corrected to 285 eV. The amount of Si derived from the organopolysiloxane structure with respect to the total amount of the constituent elements is then determined from the peak area of the SiO bond of silicon 2p orbit of which the peak top is detected at 100 eV or more and 103 eV or less, by using the relative sensitivity factor provided by ULVAC-PHI, Incorporated. When another Si 2p orbital peak ($SiO_2$: more than 103 eV and 105 eV or less) is detected, the SiO bond peak area is determined by carrying out waveform separation of the SiO bond peak.

<Method of Measuring Melting Points of Crystalline Polyester Resin, Block Polymer and Wax>

The melting points of the crystalline polyester resin, block polymer and wax are measured under the following conditions using a DSC Q2000 (manufactured by TA Instruments-Waters LLC):

Rate of temperature rise: 10° C./min
Temperature at start of measurement: 20° C.
Temperature at end of measurement: 180° C.

The melting points of indium and zinc are used for temperature correction in the detection section of the apparatus, and the heat of fusion of indium is used to correct the amount of heat.

Specifically, approximately 2 mg of the sample is accurately weighed out and placed into an aluminum pan, and one measurement is performed using an empty aluminum pan for reference. The measurement is performed after raising the temperature to 200° C. once, then lowering the temperature to 20° C., and thereafter raising the temperature again. In the case of the crystalline polyester and block polymer, the peak temperature of the maximum endothermic peak in the DSC curve in the range of a temperature of 20° C. to 200° C. in the first temperature ramp-up step is taken to be the melting point of the crystalline polyester and block polymer, while in the case of the wax, the peak temperature of the maximum endothermic peak in the DSC curve in the range of a temperature of 20° C. to 200° C. in the second temperature ramp-up step is taken to be the melting point of the wax. The rate of temperature rise and the rate of temperature fall are set to 10° C./min.

<Method of Measuring Number-Average Molecular Weight (Mn) and Weight-Average Molecular Weight (Mw)>

The molecular weight (Mn, Mw) of the tetrahydrofuran (THF)-soluble fraction of each resin is measured as follows by gel permeation chromatography (GPC).

First, the sample is dissolved in THF over 24 hours at room temperature. The obtained solution is filtered using a solvent-resistant membrane filter "MYSHORI Disk" with a pore diameter of 0.2 μm (manufactured by Tosoh Corporation) to obtain a sample solution. The sample solution is adjusted so as to provide a concentration of THF-soluble components of approximately 0.8% by mass. Measurement is performed under the following conditions using this sample solution.

Apparatus: HLC8120 GPC (detector: RI) (manufactured by Tosoh Corporation)
Columns: 7 column train of Shodex KF-801, 802, 803, 804, 805, 806 and 807 (manufactured by Showa Denko K.K.)
Eluent: tetrahydrofuran (THF)
Flow rate: 1.0 mL/min
Oven temperature: 40.0° C.
Amount of sample injected: 0.10 mL The sample molecular weight is determined using a molecular weight calibration curve produced using standard polystyrene resins (product names: "TSK Standard Polystyrene F-850, F-450, F-288, F-128, F-80, F-40, F-20, F-10, F-4, F-2, F-1, A-5000, A-2500, A-1000 and A-500," manufactured by Tosoh Corporation).

<Method of Measuring Number-Average Diameters of Resin Fine Particle L1 and Resin Fine Particle L2>

The number-average diameters of the resin fine particles L1 and L2 are measured using Zetasizer Nano-ZS (manufactured by MALVERN INSTRUMENTS LTD.). First, an organic solvent dispersion liquid of the resin fine particle to be measured is diluted so that a solid-liquid ratio is set to 0.10% by mass (±0.02% by mass), to prepare a sample. The sample is extracted in a quartz cell, and placed into a measurement unit. The refractive index of the resin fine particle, and the refractive index and viscosity of a dispersion solvent are input as measurement conditions, and the measurement is performed.

<Method of Measuring Particle Diameters of Wax Fine Particle and Colorant Fine Particle>

The particle diameter of each fine particle is measured as the volume-average particle diameter (m or nm) by measuring over a set range of 0.001 μm to 10 μm using a Microtrac particle size distribution analyzer HRA (X-100) (manufactured by Nikkiso Co., Ltd.). Furthermore, water is selected for use as the diluent solvent.

EXAMPLES

The present invention is specifically described below using Production Examples and Examples, but these Examples in no way limit the present invention.

<Synthesis of Polyester Having Polymerizable Unsaturated Group 1>

The following raw materials were charged into a heat-dried two-mouth flask while nitrogen was introduced.

Sebacic acid: 128.0 parts by mass
Fumaric acid: 2.6 parts by mass
1,6-hexanediol: 78.5 parts by mass
Dibutyltin oxide: 0.1 parts by mass After the atmosphere inside the system was replaced with nitrogen by reducing pressure, the mixture was stirred for 6 hours at 180° C. Subsequently, the temperature was gradually raised to 230° C. under reduced pressure while stirring was continued followed by holding at the temperature for 2 hours. A polyester having a polymerizable unsaturated group 1 was synthesized by allowing the mixture to be air-cooled and stopping the reaction when the mixture had reached a viscous state. The polyester having a polymerizable unsaturated group 1 had a melting point of 56° C., Mn of 19,000, and Mw of 44,000. The average of the number of polymerizable unsaturated groups contained in one molecule was 2.0.

<Preparation of Organopolysiloxane Compounds Having Vinyl Group (x1) to (x3)>

Commercially available one terminal type vinyl modified organopolysiloxanes shown in Table 1 were prepared, and used as organopolysiloxane compounds having a vinyl group (x1) to (x3). The structures of the organopolysiloxane compounds having a vinyl group (x1) to (x3) were represented by the following formula (ii), and the details of $R^2$ to $R^5$ and the values of degrees of polymerization, n were shown in Table 1.

Formula (ii)

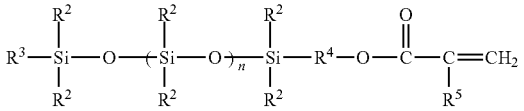

TABLE 1

| | Product name | Manufacturer name | Molecular weight | $R^2$ | $R^3$ | $R^4$ | $R^5$ | Degree of polymerization, n |
|---|---|---|---|---|---|---|---|---|
| Organopolysiloxane compound having vinyl group (x1) | X-22-2475 | Shin-Etsu Chemical Co., Ltd. | 420 | Methyl group | Methyl group | Propylene group | Methyl group | 3 |
| Organopolysiloxane compound having vinyl group (x2) | X-22-174ASX | Shin-Etsu Chemical Co., Ltd. | 900 | Methyl group | Methyl group | Propylene group | Methyl group | 10 |

TABLE 1-continued

| | Product name | Manufacturer name | Molecular weight | $R^2$ | $R^3$ | $R^4$ | $R^5$ | Degree of polymerization, n |
|---|---|---|---|---|---|---|---|---|
| Organopolysiloxane compound having vinyl group (x3) | X-22-174BX | Shin-Etsu Chemical Co., Ltd. | 2300 | Methyl group | Methyl group | Propylene group | Methyl group | 29 |

<Preparation of Polyfunctional Monomer 1>

APG400 (manufactured by Shin-Nakamura Chemical Co., Ltd.) was prepared, and used as a polyfunctional monomer 1. The structure of the polyfunctional monomer 1 was represented by the following formula (iii). The sum of the degrees of polymerization, m and n was 7, and the molecular weight was 536.

Formula (iii)

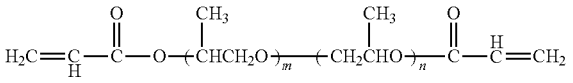

<Preparation of Resin Fine Particle L1 Dispersion Liquid 1>

The following raw materials and 800.0 parts by mass of toluene were charged into a heat-dried two-mouth flask while nitrogen was introduced. The resultant was heated to 70° C. to be completely dissolved, thereby preparing a monomer composition 1.

Polyester having polymerizable unsaturated group 1: 40.0 parts by mass

Organopolysiloxane compound having vinyl group (x1): 25.0 parts by mass

Styrene (St): 25.0 parts by mass

Methacrylic acid (MAA): 10.0 parts by mass

Polyfunctional monomer 1: 3.0 parts by mass

The temperature of the monomer composition 1 was lowered to 25° C. while the monomer composition 1 was stirred at 250 rpm. The monomer composition 1 was subjected to nitrogen bubbling for 30 minutes, and then mixed with 0.6 parts by mass of azobismethoxydimethylvaleronitrile as a polymerization initiator. Subsequently, the mixture was heated at 75° C. for reaction for 6 hours, and further heated to 80° C. for reaction for 1 hour. Subsequently, the resulting product was air-cooled to obtain a particle-like resin dispersion.

The obtained coarse-grained resin dispersion was injected into a temperature-controllable stirring tank, and transferred at a flow rate of 35 g/min to Clear SS5 (manufactured by M Technique Co., Ltd.) where the dispersion was treated, using a pump, to obtain a fine-grained resin dispersion. As the treatment conditions of the dispersion in Clear SS5, the circumferential velocity of the outermost peripheral part of a ring-shaped disk to be rotated of Clear SS5 was set to 15.7 m/s, and the distance between the ring-shaped disk to be rotated and the fixed ring-shaped disk was set to 1.6 μm. The temperature of the stirring tank was adjusted so that the temperature of the solution treated in Clear SS5 was set to 40° C. or less.

The resin fine particles and toluene in the dispersion were separated by a centrifugal separator. The conditions of centrifugal separation were shown below.

Centrifugal separator: H-9R (manufactured by Kokusan Co., Ltd.)

Rotor: $B_{N1}$ rotor (manufactured by Kokusan Co., Ltd.)

Temperature set in apparatus: 4° C.

Rotation number: 16,500 rpm

Time: 2.5 hours

Subsequently, the supernatant was removed to obtain a concentrated fine-grained resin dispersion.

The concentrated fine-grained resin dispersion and acetone were injected into a stirring apparatus-equipped beaker where the fine-grained resin was dispersed in acetone using a high-output homogenizer (VCX-750), and then, acetone was further added thereto, to prepare a resin fine particle L1 dispersion liquid 1 having a solid content concentration of 10.0% by mass. The number-average particle diameter of the resin fine particles L1 contained in the resin fine particle L1 dispersion liquid 1 thus prepared was 0.14 μm.

A resin R1 was obtained by filtering and drying part of the resin fine particle L1 dispersion liquid 1 and solidifying the resin fine particle L1. The amount X1 of Si of the extracted resin R1 measured by fluorescent X-ray analysis (XRF) was 7.7% by mass. The amount of Si derived from organopolysiloxane of the extracted resin R1 measured by ESCA was obtained. The value was used as the amount Al of Si derived from the organopolysiloxane group of the resin fine particle L1 measured by ESCA. The amount A1 was 5.1 atomic %. Part of the resin fine particle L1 dispersion liquid 1 was taken out, and subjected to the exposure treatment using carbon dioxide in a liquid state, as described above. The amount B1 of Si derived from organopolysiloxane after the exposure treatment was 6.6 atomic %. The degree of change B1/A1 in the surface composition of the resin fine particle L1 before and after the exposure was 1.29.

The SP value SP (R1) of the resin R1 contained in the resin fine particle L1 determined by the measurement method from the amount charged was 17.2 $(J/cm^3)^{1/2}$. The mass ratio (E1/S1) of the organopolysiloxane compound having a vinyl group (E1) to the polyester having a polymerizable unsaturated group (S1) determined from the amount charged was 1.6, and the sum (E1+S1) was 63.1% by mass.

<Preparation of Resin Fine Particle L1 Dispersion Liquids 2 to 18>

When the resin fine particle L1 dispersion liquid 1 was prepared, the amounts of the polyester having a polymerizable unsaturated group 1, organopolysiloxane compound having a vinyl group, polyfunctional monomer 1, styrene, and methacrylic acid added, and the kinds of the organopolysiloxane compound having a vinyl group were changed as shown in Table 2, to obtain resin fine particle L1 dispersion liquids 2 to 18. A1 (atomic %), B1 (atomic %), B1/A1 and volume-average particle diameter (μm) of the resin fine particles L1 contained in the obtained resin fine particle L1 dispersion liquids 2 to 18 are shown in Table 2.

SP (R1) $((J/cm^3)^{1/2})$, X1 (% by mass), E1/S1, and E1+S1 of the resin R1 are shown in Table 3.

TABLE 2

| Resin fine particle L1 | Amount added (parts by mass) Organopolysiloxane compound having vinyl group | | Polyester having polymerizable unsaturated group 1 | Polyfunctional monomer 1 | St | MAA | Amount of Si, A1 (atomic %) | Amount of Si, B1 (atomic %) | B1/A1 | Number-average particle diameter Dv(μm) |
|---|---|---|---|---|---|---|---|---|---|---|
| L1 dispersion liquid 1 | x1 | 25.0 | 40.0 | 3.0 | 25.0 | 10.0 | 5.1 | 6.6 | 1.29 | 0.14 |
| L1 dispersion liquid 2 | x1 | 29.0 | 40.0 | 5.0 | 21.0 | 10.0 | 5.9 | 6.5 | 1.10 | 0.14 |
| L1 dispersion liquid 3 | x1 | 19.0 | 36.0 | 3.0 | 35.0 | 10.0 | 3.7 | 4.8 | 1.30 | 0.14 |
| L1 dispersion liquid 4 | x1 | 17.0 | 33.0 | 3.0 | 40.0 | 10.0 | 5.9 | 7.6 | 1.29 | 0.14 |
| L1 dispersion liquid 5 | x1 | 29.0 | 40.0 | 3.0 | 21.0 | 10.0 | 5.9 | 7.6 | 1.29 | 0.14 |
| L1 dispersion liquid 6 | x1 | 25.0 | 40.0 | 1.0 | 25.0 | 10.0 | 5.1 | 7.7 | 1.51 | 0.14 |
| L1 dispersion liquid 7 | x1 | 25.0 | 40.0 | 4.5 | 25.0 | 10.0 | 5.1 | 5.8 | 1.14 | 0.14 |
| L1 dispersion liquid 8 | x1 | 25.0 | 40.0 | 5.0 | 25.0 | 10.0 | 5.1 | 5.6 | 1.08 | 0.14 |
| L1 dispersion liquid 9 | x1 | 25.0 | 30.0 | 3.0 | 35.0 | 10.0 | 4.6 | 6.1 | 1.31 | 0.14 |
| L1 dispersion liquid 10 | x1 | 20.0 | 45.0 | 3.0 | 25.0 | 10.0 | 4.3 | 5.5 | 1.28 | 0.13 |
| L1 dispersion liquid 11 | x1 | 25.0 | 55.0 | 3.0 | 10.0 | 10.0 | 5.8 | 7.4 | 1.28 | 0.15 |
| L1 dispersion liquid 12 | x2 | 25.0 | 40.0 | 3.0 | 25.0 | 10.0 | 5.1 | 6.8 | 1.33 | 0.13 |
| L1 dispersion liquid 13 | x3 | 25.0 | 40.0 | 3.0 | 25.0 | 10.0 | 5.1 | 7.0 | 1.37 | 0.12 |
| L1 dispersion liquid 14 | x1 | 30.0 | 40.0 | 5.5 | 20.0 | 10.0 | 6.1 | 6.3 | 1.03 | 0.13 |
| L1 dispersion liquid 15 | x1 | 32.0 | 40.0 | 5.0 | 18.0 | 10.0 | 6.4 | 7.0 | 1.09 | 0.13 |
| L1 dispersion liquid 16 | x1 | 16.0 | 40.0 | 3.0 | 34.0 | 10.0 | 3.2 | 4.1 | 1.28 | 0.15 |
| L1 dispersion liquid 17 | x1 | 15.0 | 24.0 | 3.0 | 51.0 | 10.0 | 2.4 | 3.2 | 1.33 | 0.14 |
| L1 dispersion liquid 18 | x1 | 45.0 | 40.0 | 5.0 | 5.0 | 10.0 | 8.7 | 8.7 | 1.00 | 0.13 |

TABLE 3

| Resin R1 | SP (R1) $[(J/cm^3)^{1/2}]$ | Amount of Si, X1 (% by mass) | E1/S1 | E1 + S1 |
|---|---|---|---|---|
| L1 dispersion liquid 1 | 17.2 | 7.7 | 1.6 | 63.1 |
| L1 dispersion liquid 2 | 16.9 | 8.7 | 1.4 | 65.7 |
| L1 dispersion liquid 3 | 17.7 | 5.8 | 1.9 | 53.4 |
| L1 dispersion liquid 4 | 17.9 | 5.2 | 1.9 | 48.5 |
| L1 dispersion liquid 5 | 16.9 | 8.9 | 1.4 | 67.0 |
| L1 dispersion liquid 6 | 17.1 | 7.7 | 1.6 | 63.7 |
| L1 dispersion liquid 7 | 17.2 | 7.5 | 1.6 | 62.2 |
| L1 dispersion liquid 8 | 17.2 | 7.5 | 1.6 | 61.9 |
| L1 dispersion liquid 9 | 17.4 | 7.7 | 1.2 | 53.4 |
| L1 dispersion liquid 10 | 17.5 | 6.1 | 2.3 | 63.1 |
| L1 dispersion liquid 11 | 16.9 | 7.7 | 2.2 | 77.7 |
| L1 dispersion liquid 12 | 17.2 | 7.7 | 1.6 | 63.1 |
| L1 dispersion liquid 13 | 17.2 | 7.7 | 1.6 | 63.1 |
| L1 dispersion liquid 14 | 16.8 | 8.9 | 1.3 | 66.4 |
| L1 dispersion liquid 15 | 16.7 | 9.6 | 1.3 | 68.6 |
| L1 dispersion liquid 16 | 17.9 | 4.9 | 2.5 | 54.4 |

TABLE 3-continued

| Resin R1 | SP (R1) $[(J/cm^3)^{1/2}]$ | Amount of Si, X1 (% by mass) | E1/S1 | E1 + S1 |
|---|---|---|---|---|
| L1 dispersion liquid 17 | 18.4 | 4.6 | 1.6 | 37.9 |
| L1 dispersion liquid 18 | 15.6 | 13.5 | 0.9 | 81.0 |

<Preparation of Resin Fine Particle L2 Dispersion Liquids 1 to 7>

When the resin fine particle L1 dispersion liquid 1 wad prepared, the amounts of the polyester having a polymerizable unsaturated group 1, organopolysiloxane compound having a vinyl group, polyfunctional monomer 1, styrene, and methacrylic acid added, and the kinds of the organopolysiloxane compound having a vinyl group were changed as shown in Table 4, to obtain resin fine particle L2 dispersion liquids 1 to 7. B2 (atomic %) and number-average particle diameter (μm) of the resin fine particles L2 contained in the obtained resin fine particle L2 dispersion liquids 1 to 7 are shown in Table 4.

SP (R2) $(J/cm^3)^{1/2}$), X2 (% by mass), E2/S2, and E2+S2 of the resin R2 are shown in Table 5.

TABLE 4

| Resin fine particle L2 | Amount added (parts by mass) Organopolysiloxane compound having vinyl group | | Polyester having polymerizable unsaturated group 1 | Polyfunctional monomer 1 | St | MAA | Amount of Si, B2 (atomic %) | Number-average particle diameter Dv(μm) |
|---|---|---|---|---|---|---|---|---|
| L2 dispersion liquid 1 | x1 | 45.0 | 40.0 | 5.0 | 5.0 | 10.0 | 8.7 | 0.14 |
| L2 dispersion liquid 2 | x1 | 35.0 | 40.0 | 5.0 | 15.0 | 10.0 | 7.0 | 0.14 |
| L2 dispersion liquid 3 | x1 | 55.0 | 30.0 | 5.0 | 5.0 | 10.0 | 9.8 | 0.14 |
| L2 dispersion liquid 4 | x1 | 32.0 | 40.0 | 5.0 | 18.0 | 10.0 | 6.4 | 0.14 |
| L2 dispersion liquid 5 | x1 | 25.0 | 53.0 | 5.0 | 12.0 | 10.0 | 5.7 | 0.14 |
| L2 dispersion liquid 6 | x1 | 60.0 | 25.0 | 5.0 | 10.0 | 10.0 | 10.3 | 0.14 |
| L2 dispersion liquid 7 | x1 | 25.0 | 40.0 | 5.0 | 25.0 | 10.0 | 5.1 | 0.14 |

TABLE 5

| Resin R2 | SP (R2) [(J/cm$^3$)$^{1/2}$] | Amount of Si, X2 (% by mass) | E2/S2 | E2 + S2 |
|---|---|---|---|---|
| L2 dispersion liquid 1 | 15.7 | 13.6 | 0.9 | 85.0 |
| L2 dispersion liquid 2 | 16.4 | 10.6 | 1.1 | 75.0 |
| L2 dispersion liquid 3 | 15.1 | 16.7 | 0.5 | 85.0 |
| L2 dispersion liquid 4 | 16.7 | 9.7 | 1.3 | 72.0 |
| L2 dispersion liquid 5 | 16.9 | 7.5 | 2.1 | 78.0 |
| L2 dispersion liquid 6 | 14.8 | 18.2 | 0.4 | 85.0 |
| L2 dispersion liquid 7 | 17.2 | 7.6 | 1.6 | 65.0 |

<Synthesis of Crystalline Polyester 1>

The following raw materials were charged into a heat-dried two-mouth flask while nitrogen was introduced.

Sebacic acid: 123.0 parts by mass 1,6-hexanediol: 76.0 parts by mass

Dibutyltin oxide: 0.1 parts by mass

After the atmosphere inside the system was replaced with nitrogen by reducing pressure, the mixture was stirred for 6 hours at 180° C. Subsequently, the temperature was gradually raised to 230° C. under reduced pressure while stirring was continued followed by holding at the temperature for 2 hours. A crystalline polyester 1 was synthesized by allowing the mixture to be air-cooled and stopping the reaction when the mixture had reached a viscous state. The crystalline polyester 1 had a melting point of 73° C., Mn of 5,800, and Mw of 11,800.

<Synthesis of Block Polymer 1>

Crystalline polyester 1: 210.0 parts by mass

Xylylene diisocyanate (XDI): 56.0 parts by mass

Cyclohexanedimethanol (CHDM): 34.0 parts by mass

Tetrahydrofuran (THF): 300.0 parts by mass

While substituting with nitrogen was carried out, the above-mentioned materials were charged into a reactor equipped with a stirring apparatus and a thermometer. The mixture was heated to 50° C. and an urethanation reaction was carried out over 15 hours. The THF solvent was distilled out to obtain a block polymer 1. The block polymer 1 had a melting point of 65° C., Mn of 16,500, and Mw of 33,500.

<Preparation of Block Polymer Solution 1>

128.0 parts by mass of acetone as an organic solvent and 72.0 parts by mass of the block polymer 1 were injected into a stirring apparatus-equipped beaker, and heated to 50° C. A block polymer solution 1 having an amount of solid content of 36.0% by mass was prepared by continuing to stir until complete dissolution was achieved.

<Preparation of Colorant Dispersion Liquid 1>

C.I. Pigment Blue 15:3: 100.0 parts by mass

Acetone: 150.0 parts by mass

Glass beads (1 mm): 300.0 parts by mass

These materials were injected into a heat-resistant glass container; dispersion was carried out for 5 hours using a paint shaker (manufactured by Toyo Seiki Seisaku-sho, Ltd.); and the glass beads were removed with a nylon mesh to obtain a colorant dispersion liquid 1 having a volume-average particle diameter of 200 nm and an amount of solid content of 40.0% by mass.

<Preparation of Wax Dispersion Liquid 1>

Dipentaerythritol palmitic acid ester wax: 16.0 parts by mass

Wax dispersant: 8.0 parts by mass (Copolymer obtained by graft-copolymerizing 50.0 parts by mass of styrene, 25.0 parts by mass of n-butyl acrylate and 10.0 parts by mass of acrylonitrile in the presence of 15.0 parts by mass of polyethylene, and having a peak molecular weight of 8,500)

Acetone: 76.0 parts by mass

The above-mentioned materials were injected into a glass beaker (manufactured by Iwaki Glass Co., Ltd.) equipped with an impeller, and the wax was dissolved in acetone by heating the system to 50° C.

Next, the system was gradually cooled while gentle stirring was carried out at 50 rpm, and cooled to 25° C. over 3 hours to obtain a milky white liquid.

This solution was injected into a heat-resistant container along with 20.0 parts by mass of 1 mm glass beads, and after dispersion was carried out for 3 hours with a paint shaker, the glass beads were removed with a nylon mesh to obtain a wax dispersion liquid 1 having a volume-average particle diameter of 270 nm and an amount of solid content of 24.0% by mass.

Example 1

In the apparatus shown in FIGURE, valves V1, V2 and V3 and a pressure regulating valve V4 were first closed; 18.0 parts by mass of a resin fine particle L1 dispersion liquid 1 was charged into a pressure granulation tank T1 equipped with a stirring apparatus and a filter for capturing toner particles; and the internal temperature was adjusted to 40° C. Next, the valve V1 was opened; carbon dioxide (purity: 99.99%) was introduced into the granulation tank T1 from a carbon dioxide cylinder B1 using a pump P1; and the valve V1 was closed when the internal pressure reached 2.0 MPa.

On the other hand, a block polymer solution 1, a colorant dispersion liquid 1 and a wax dispersion liquid 1 were charged into a resin solution tank T2 to prepare a resin solution, and the internal temperature was then adjusted to 40° C. The valve V2 was opened, and the resin solution of the resin solution tank T2 was introduced into the granulation tank T1 using a pump P2 while stirring was carried out at 2,000 rpm in the granulation tank T1. The valve V2 was closed after the introduction of the resin solution was entirely completed. The internal pressure of the granulation tank T1 after the introduction was 3.0 MPa. The total mass of the carbon dioxide introduced was measured using a mass flow meter, and was 280.0 parts by mass.

The amounts (mass ratio) of the materials charged into the resin solution tank T2 are as follows.

Block polymer solution 1: 100.0 parts by mass

Wax dispersion liquid 1: 10.0 parts by mass

Colorant dispersion liquid 1: 6.0 parts by mass

After the introduction of the contents of the resin solution tank T2 into the granulation tank T1 had been completed, the dispersion containing the droplets of the resin solution was formed by stirring for 3 minutes at 2,000 rpm.

Next, 10.8 parts by mass of a resin fine particle L2 dispersion liquid 1 was charged into a resin fine particle dispersion liquid tank T3, and the internal temperature was then adjusted to 40° C. The valve V3 was opened, and the resin fine particle L2 dispersion liquid 1 in the resin fine particle L2 dispersion liquid tank T3 was introduced into the granulation tank T1 using a pump P3 while stirring was carried out at 2,000 rpm in the granulation tank T1. The valve V3 was closed after the introduction of the resin fine particle L2 dispersion liquid 1 was entirely completed. The internal pressure of the granulation tank T1 after the introduction was 3.1 MPa.

Next, the valve V1 was opened; carbon dioxide was introduced into the granulation tank T1 from the carbon dioxide cylinder B1 using the pump P1; and the valve V1 was closed when the internal pressure reached 10.0 MPa.

Thus, acetone contained in the droplets in the dispersion was extracted into a dispersion medium.

The valve V1 and the pressure regulating valve V4 were then opened, and additional carbon dioxide was circulated using the pump P1 while the internal pressure of the granulation tank T1 was held at 10.0 MPa. As a result of this operation, carbon dioxide containing acetone as the organic solvent extracted was discharged into a solvent recovery tank T4, and acetone and carbon dioxide were separated.

After the discharge of carbon dioxide into the organic solvent recovery tank T4 was started, acetone in the organic solvent recovery tank T4 was taken out at five-minute intervals. The work was continued until acetone was not stored in the organic solvent recovery tank T4 and could not be taken out. When acetone was no longer taken out, the removal of the solvent was completed, and the valve V1 and the pressure regulating valve V4 were closed, to complete the circulation of carbon dioxide.

Furthermore, the pressure regulating valve V4 was opened, and toner particles 1 captured by the filter were recovered by reducing the internal pressure of the granulation tank T1 to atmospheric pressure.

In Example 1, the relation [f (SP)] of the SP values of the resin fine particle L1 used and the resin fine particle L2 is 8.7; the relation [X2/X1] of the amounts of Si measured by fluorescent X-ray analysis (XRF) is 1.8; and the relation [B2/B1] of the amounts of Si derived from organopolysiloxane after being subjected to the exposure treatment using carbon dioxide in the liquid state is 1.3.

The obtained toner particle 1 was evaluated for particle size distribution and a circularity. D1 was 5.6 μm; D4 was 6.3 μm; D4/D1 was 1.12; an average circularity was 0.99; and a circularity variation coefficient was 2.82.

The particle size distribution was evaluated according to the following criteria.

A: The D4/D1 value was less than 1.15.
B: The D4/D1 value was 1.15 or more and less than 1.20.
C: The D4/D1 value was 1.20 or more and less than 1.25.
D: The D4/D1 value was 1.25 or more and less than 1.30.
E: The D4/D1 value was 1.30 or more.

The circularity variation coefficient was evaluated according to the following criteria.

A: The circularity variation coefficient was less than 3.00.
B: The circularity variation coefficient was 3.00 or more and less than 3.50.
C: The circularity variation coefficient was 3.50 or more and less than 4.00.
D: The circularity variation coefficient was 4.00 or more and less than 4.50.
E: The circularity variation coefficient was 4.50 or more.

Examples 2 to 21 and Comparative Examples 1 to 8

Toner particles 2 to 21 and comparative toner particles 1 to 8 were obtained in the same manner as in Example 1 except that in Example 1, the kinds and parts of the resin fine particle L1 dispersion liquid 1 and resin fine particle L2 dispersion liquid 1 were changed as shown in Table 6. [f (SP)], [X2/X1] and [B2/B1] at this time are shown in Table 6.

The evaluation results of the obtained toner particles 2 to 21 and comparative toner particles 1 to 8 are shown in Table 7.

Example 22

In the same manner as in Example 1, a resin solution was introduced into the pressure tank T1, and a dispersion containing the droplets of the resin solution was formed by the same operation as that of Example 1.

Next, 5.4 parts by mass of a resin fine particle L2 dispersion liquid 1 was charged into the resin fine particle dispersion liquid tank T3, and the internal temperature was then adjusted to 40° C. The valve V3 was opened, and the resin fine particle L2 dispersion liquid 1 in the resin fine particle dispersion liquid tank T3 was introduced into the granulation tank T1 using the pump P3 while stirring was carried out at 2,000 rpm in the granulation tank T1. The valve V3 was closed after the introduction of the resin fine particle L2 dispersion liquid 1 was entirely completed. The internal pressure of the granulation tank T1 after the introduction was 3.1 MPa.

Next, the valve V1 was opened; carbon dioxide was introduced into the granulation tank T1 from the carbon dioxide cylinder B1 using the pump P1; and the valve V1 was closed when the internal pressure reached 4.0 MPa. The total mass of the carbon dioxide introduced was measured using a mass flow meter, and was 320.0 parts by mass.

Furthermore, 5.4 parts by mass of the resin fine particle L2 dispersion liquid 1 was charged into the resin fine particle dispersion liquid tank T3, and the internal temperature was then adjusted to 40° C. The valve V3 was opened, and the resin fine particle L2 dispersion liquid 1 in the resin fine particle dispersion liquid tank T3 was introduced into the granulation tank T1 using the pump P3 while stirring was carried out at 2,000 rpm in the granulation tank T1. The valve V3 was closed after the introduction of the resin fine particle L2 dispersion liquid 1 was entirely completed. The internal pressure of the granulation tank T1 after the introduction was 4.1 MPa.

Next, the valve V1 was opened; carbon dioxide was introduced into the granulation tank T1 from the carbon dioxide cylinder B1 using the pump P1; and the valve V1 was closed when the internal pressure reached 10.0 MPa. Thus, acetone contained in the droplets in the dispersion was extracted into a dispersion medium. The valve V1 and the pressure regulating valve V4 were then opened, and additional carbon dioxide was circulated using the pump P1 while the internal pressure of the granulation tank T1 was held at 10.0 MPa. As a result of this operation, carbon dioxide containing acetone as the organic solvent extracted was discharged into the solvent recovery tank T4, and acetone and carbon dioxide were separated.

After the discharge of carbon dioxide into the organic solvent recovery tank T4 was started, acetone in the organic solvent recovery tank T4 was taken out at five-minute intervals. The work was continued until acetone was not stored in the organic solvent recovery tank T4 and could not be taken out. When acetone was no longer taken out, the removal of the solvent was completed, and the valve V1 and the pressure regulating valve V4 were closed, to complete the circulation of carbon dioxide.

Furthermore, the pressure regulating valve V4 was opened, and toner particles 22 captured by the filter were recovered by reducing the internal pressure of the granulation tank T1 to atmospheric pressure.

[f (SP)], [X2/X1] and [B2/B1] at this time are shown in Table 6. The evaluation result of the obtained toner particle 22 is shown in Table 7.

TABLE 6

| | Resin fine particle L1 dispersion liquid | | Amount of resin fine particle L1 added to binder | Resin fine particle L2 dispersion liquid | | Amount of resin fine particle L2 added to binder | | | |
|---|---|---|---|---|---|---|---|---|---|
| | Kind | Parts | resin | Kind | Parts | resin | f(SP)*1 | X2/X1 | B2/B1 |
| Example 1 | L1 dispersion liquid 1 | 18.0 | 5.0 | L2 dispersion liquid 1 | 10.8 | 3.0 | 8.7 | 1.8 | 1.3 |
| Example 2 | L1 dispersion liquid 1 | 18.0 | 5.0 | L2 dispersion liquid 2 | 10.8 | 3.0 | 4.7 | 1.4 | 1.1 |
| Example 3 | L1 dispersion liquid 2 | 18.0 | 5.0 | L2 dispersion liquid 2 | 10.8 | 3.0 | 3.0 | 1.2 | 1.1 |
| Example 4 | L1 dispersion liquid 3 | 18.0 | 5.0 | L2 dispersion liquid 1 | 10.8 | 3.0 | 11.3 | 2.4 | 1.8 |
| Example 5 | L1 dispersion liquid 3 | 18.0 | 5.0 | L2 dispersion liquid 3 | 10.8 | 3.0 | 14.7 | 2.9 | 2.0 |
| Example 6 | L1 dispersion liquid 4 | 18.0 | 5.0 | L2 dispersion liquid 1 | 10.8 | 3.0 | 12.3 | 2.7 | 2.1 |
| Example 7 | L1 dispersion liquid 5 | 18.0 | 5.0 | L2 dispersion liquid 1 | 10.8 | 3.0 | 7.1 | 1.6 | 1.3 |
| Example 8 | L1 dispersion liquid 1 | 18.0 | 5.0 | L2 dispersion liquid 3 | 10.8 | 3.0 | 12.2 | 2.2 | 1.5 |
| Example 9 | L1 dispersion liquid 1 | 18.0 | 5.0 | L2 dispersion liquid 4 | 10.8 | 3.0 | 2.9 | 1.3 | 1.0 |
| Example 10 | L1 dispersion liquid 6 | 18.0 | 5.0 | L2 dispersion liquid 1 | 10.8 | 3.0 | 8.2 | 1.8 | 1.2 |
| Example 11 | L1 dispersion liquid 7 | 18.0 | 5.0 | L2 dispersion liquid 1 | 10.8 | 3.0 | 8.7 | 1.8 | 1.5 |
| Example 12 | L1 dispersion liquid 8 | 18.0 | 5.0 | L2 dispersion liquid 1 | 10.8 | 3.0 | 8.7 | 1.8 | 1.6 |
| Example 13 | L1 dispersion liquid 9 | 18.0 | 5.0 | L2 dispersion liquid 1 | 10.8 | 3.0 | 9.8 | 1.8 | 1.4 |
| Example 14 | L1 dispersion liquid 10 | 18.0 | 5.0 | L2 dispersion liquid 1 | 10.8 | 3.0 | 10.3 | 2.3 | 1.6 |
| Example 15 | L1 dispersion liquid 11 | 18.0 | 5.0 | L2 dispersion liquid 1 | 10.8 | 3.0 | 7.1 | 1.8 | 1.2 |
| Example 16 | L1 dispersion liquid 12 | 18.0 | 5.0 | L2 dispersion liquid 1 | 10.8 | 3.0 | 8.7 | 1.8 | 1.3 |
| Example 17 | L1 dispersion liquid 13 | 18.0 | 5.0 | L2 dispersion liquid 1 | 10.8 | 3.0 | 8.7 | 1.8 | 1.3 |
| Example 18 | L1 dispersion liquid 1 | 11.5 | 3.2 | L2 dispersion liquid 1 | 10.8 | 3.0 | 8.7 | 1.8 | 1.3 |
| Example 19 | L1 dispersion liquid 1 | 34.2 | 9.5 | L2 dispersion liquid 1 | 10.8 | 3.0 | 8.7 | 1.8 | 1.3 |
| Example 20 | L1 dispersion liquid 1 | 18.0 | 5.0 | L2 dispersion liquid 1 | 10.8 | 1.2 | 8.7 | 1.8 | 1.3 |
| Example 21 | L1 dispersion liquid 1 | 18.0 | 5.0 | L2 dispersion liquid 1 | 16.2 | 4.5 | 8.7 | 1.8 | 1.3 |
| Example 22 | L1 dispersion liquid 1 | 18.0 | 5.0 | L2 dispersion liquid 1 | 10.8 | 3.0 | 8.7 | 1.8 | 1.3 |
| Comparative Example 1 | L1 dispersion liquid 14 | 18.0 | 5.0 | L2 dispersion liquid 4 | 10.8 | 3.0 | 0.6 | 1.1 | 1.0 |
| Comparative Example 2 | L1 dispersion liquid 1 | 18.0 | 5.0 | L2 dispersion liquid 5 | 10.8 | 3.0 | 1.7 | 1.0 | 0.9 |
| Comparative Example 3 | L1 dispersion liquid 15 | 18.0 | 5.0 | L2 dispersion liquid 2 | 10.8 | 3.0 | 1.8 | 1.1 | 1.1 |
| Comparative Example 4 | L1 dispersion liquid 16 | 18.0 | 5.0 | L2 dispersion liquid 3 | 10.8 | 3.0 | 15.6 | 3.4 | 2.4 |
| Comparative Example 5 | L1 dispersion liquid 17 | 18.0 | 5.0 | L2 dispersion liquid 1 | 10.8 | 3.0 | 15.2 | 3.0 | 2.7 |
| Comparative Example 6 | L1 dispersion liquid 2 | 18.0 | 5.0 | L2 dispersion liquid 6 | 10.8 | 3.0 | 16.4 | 3.2 | 2.2 |
| Comparative Example 7 | L1 dispersion liquid 1 | 18.0 | 5.0 | L2 dispersion liquid 7 | 10.8 | 3.0 | 0.0 | 1.0 | 0.8 |
| Comparative Example 8 | L1 dispersion liquid 18 | 18.0 | 5.0 | L2 dispersion liquid 7 | 10.8 | 3.0 | −10.3 | 0.6 | 0.6 |

*1 f (SP) = (SP (R1) − SP (R2))/SP (R1) × 100

TABLE 7

| | | Particle size distribution | | | | Circularity | | |
|---|---|---|---|---|---|---|---|---|
| | | | | | | Average | Variation | |
| | | D4 | D1 | D4/D1 | Evaluation | circularity | coefficient | Evaluation |
| Example 1 | Toner particle 1 | 6.3 | 5.6 | 1.12 | A | 0.99 | 2.82 | A |
| Example 2 | Toner particle 2 | 6.8 | 6.0 | 1.14 | A | 0.98 | 3.19 | B |
| Example 3 | Toner particle 3 | 7.2 | 6.1 | 1.18 | B | 0.97 | 3.76 | C |
| Example 4 | Toner particle 4 | 7.3 | 6.2 | 1.17 | B | 0.98 | 3.25 | B |
| Example 5 | Toner particle 5 | 7.7 | 6.3 | 1.22 | C | 0.98 | 3.47 | B |
| Example 6 | Toner particle 6 | 7.7 | 6.4 | 1.21 | C | 0.98 | 3.30 | B |
| Example 7 | Toner particle 7 | 7.1 | 6.1 | 1.17 | B | 0.99 | 2.97 | A |
| Example 8 | Toner particle 8 | 7.3 | 6.1 | 1.19 | B | 0.99 | 3.66 | C |
| Example 9 | Toner particle 9 | 7.3 | 6.2 | 1.18 | B | 0.97 | 3.73 | C |
| Example 10 | Toner particle 10 | 7.2 | 6.1 | 1.18 | B | 0.99 | 2.98 | A |
| Example 11 | Toner particle 11 | 6.9 | 6.1 | 1.13 | A | 0.98 | 3.04 | B |
| Example 12 | Toner particle 12 | 7.3 | 6.3 | 1.16 | B | 0.98 | 3.38 | B |
| Example 13 | Toner particle 13 | 6.9 | 6.0 | 1.15 | B | 0.99 | 2.94 | A |
| Example 14 | Toner particle 14 | 6.9 | 6.1 | 1.13 | A | 0.98 | 3.08 | B |
| Example 15 | Toner particle 15 | 7.2 | 6.1 | 1.18 | B | 0.97 | 3.64 | C |
| Example 16 | Toner particle 16 | 6.5 | 5.8 | 1.12 | A | 0.99 | 2.87 | A |
| Example 17 | Toner particle 17 | 6.9 | 6.0 | 1.15 | B | 0.99 | 2.93 | A |
| Example 18 | Toner particle 18 | 7.4 | 6.4 | 1.16 | B | 0.98 | 3.35 | B |
| Example 19 | Toner particle 19 | 6.8 | 5.7 | 1.19 | B | 0.98 | 3.11 | B |
| Example 20 | Toner particle 20 | 7.3 | 6.3 | 1.16 | B | 0.98 | 3.36 | B |

TABLE 7-continued

| | | Particle size distribution | | | | Circularity | | |
|---|---|---|---|---|---|---|---|---|
| | | | | | | Average | Variation | |
| | | D4 | D1 | D4/D1 | Evaluation | circularity | coefficient | Evaluation |
| Example 21 | Toner particle 21 | 6.9 | 5.9 | 1.17 | B | 0.99 | 2.96 | A |
| Example 22 | Toner particle 22 | 6.3 | 5.7 | 1.11 | A | 0.99 | 2.78 | A |
| Comparative Example 1 | Comparative toner particle 1 | 8.2 | 6.6 | 1.24 | C | 0.95 | 4.16 | D |
| Comparative Example 2 | Comparative toner particle 2 | 8.4 | 6.8 | 1.23 | C | 0.96 | 4.37 | D |
| Comparative Example 3 | Comparative toner particle 3 | 8.2 | 6.7 | 1.23 | C | 0.96 | 4.28 | D |
| Comparative Example 4 | Comparative toner particle 4 | 9.0 | 7.1 | 1.27 | D | 0.97 | 3.91 | C |
| Comparative Example 5 | Comparative toner particle 5 | 9.1 | 7.3 | 1.25 | D | 0.97 | 3.78 | C |
| Comparative Example 6 | Comparative toner particle 6 | 9.1 | 7.2 | 1.26 | D | 0.97 | 3.82 | C |
| Comparative Example 7 | Comparative toner particle 7 | 9.8 | 7.6 | 1.29 | D | 0.94 | 4.57 | E |
| Comparative Example 8 | Comparative toner particle 8 | 10.9 | 8.1 | 1.34 | E | 0.94 | 4.62 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-131016, filed Jun. 30, 2015, which is hereby incorporated by reference herein in its entirety.

What is claimed is:

1. A method of producing a toner comprising a toner particle, the method comprising:

a) preparing a resin solution comprising a binder resin, a colorant and an organic solvent;

b) providing in a pressure container a dispersion in which a droplet of the resin solution is dispersed in a dispersion medium containing carbon dioxide, a surface of the droplet of the resin solution being covered with a resin fine particle L1 comprising a resin R1;

c) further introducing into the dispersion a resin fine particle L2 comprising a resin R2;

d) pressurizing the dispersion by introducing carbon dioxide into the pressure container, and extracting the organic solvent in the droplet into the dispersion medium; and e) obtaining the toner particle by removing the carbon dioxide together with the extracted organic solvent from inside of the pressure container, wherein the resin R1 and the resin R2 comprise a segment having an organopolysiloxane structure, and the resin R1 and the resin R2 satisfy formula (1):

$$2.0 \leq (SP(R1)-SP(R2))/SP(R1) \times 100 \leq 15.0 \quad (1)$$

where SP (R1) represents a solubility parameter of the resin R1 $((J/cm^3)^{1/2}$ and SP (R2) represents a solubility parameter of the resin R2 $((J/cm^3)^{1/2})$.

2. The method of producing a toner according to claim 1, wherein the resin R1 and the resin R2 satisfy formula (2):

$$1.2 < X2/X1 \leq 3.0 \quad (2)$$

where X1 represents an amount of Si measured by fluorescent X-ray analysis (XRF) of the resin R1 and X2 represents an amount of Si measured by fluorescent X-ray analysis (XRF) of the resin R2.

3. The method of producing a toner according to claim 1, wherein the resin fine particle L1 and the resin fine particle L2 satisfy formulae (3) to (6):

$$3.0 \leq A1 \leq 6.0 \quad (3)$$

$$B1/A1 \geq 1.10 \quad (4);$$

$$B2/B1 \geq 1.10 \quad (5); \text{ and}$$

$$6.0 \leq B2 \leq 10.0 \quad (6)$$

where A1 represents an amount (atomic%) of Si derived from a segment having an organopolysiloxane structure of the resin R1 measured by X-ray photoelectron spectroscopy analysis (ESCA) of the resin fine particle L1, B1 represents an amount (atomic%) of Si derived from a segment having an organopolysiloxane structure of the resin R1 measured by ESCA of a treated resin fine particle L1, the treated resin fine particle L1 being obtained by placing a dispersion in which the resin fine particle L1 is dispersed in the organic solvent into a pressure container, introducing carbon dioxide into the pressure container, and removing the organic solvent from the dispersion by flowing the carbon dioxide through the pressure container while maintaining a temperature at 25° C. and an internal pressure at 6.5 MPa, and B2 represents an amount (atomic%) of Si derived from a segment having an organopolysiloxane structure of the resin R2 measured by ESCA of a treated resin fine particle L2, the treated resin fine particle L2 being obtained by placing a dispersion in which the resin fine particle L2 is dispersed in the organic solvent into a pressure container, introducing carbon dioxide into the pressure container, and removing the organic solvent from the dispersion by flowing the carbon dioxide through the pressure container while maintaining a temperature at 25° C. and an internal pressure at 6.5 MPa.

4. The method of producing a toner according to claim 1, wherein the resin R1 and the resin R2 are obtained by polymerizing a monomer composition comprising an organopolysiloxane compound having a vinyl group, and a polyester having a polymerizable unsaturated group.

5. The method of producing a toner according to claim 4, wherein a mass ratio (E1/S1) of the polyester having a polymerizable unsaturated group (E1) to the organopolysiloxane compound having a vinyl group (S1) in the resin R1 is 1.0 to 2.3, and a sum (E1+S1) of the organopolysiloxane compound and the polyester having a polymerizable unsaturated group is 45.0 to 90.0% by mass based on a total amount of the monomer composition used for the resin R1.

6. The method of producing a toner according to claim 4, wherein a mass ratio (E2/S2) of the polyester having a polymerizable unsaturated group (E2) to the organopolysiloxane compound having a vinyl group (S2) in the resin R2 is 0.5 to 1.8, and a sum (E2+S2) of the organopolysiloxane compound and the polyester having a polymerizable unsaturated group is 65.0 to 90.0% by mass based on a total amount of the monomer composition used for the resin R2.

7. The method of producing a toner according to claim 4, wherein the organopolysiloxane compound having a vinyl group in the resin R1 and the resin R2 has a weight-average molecular weight of 400 to 2,000.

8. The method of producing a toner according to claim 1, wherein the resin fine particle L1and the resin fine particle L2 satisfy formulae (7) to (9):

$$1.0 \leq M1 \leq 10.0 \quad (7)$$

$$1.0 \leq M2 \leq 10.0 \quad (8); \text{ and}$$

$$M1 \geq M2 \quad (9)$$

where M1 represents an amount (parts by mass) of the resin fine particle L1 based on 100 parts by mass of the binder resin and M2 represents an amount (parts by mass) of the resin fine particle L2 ased on 100 parts by mass of the binder resin.

* * * * *